US007349002B2

(12) United States Patent
Kanemaru et al.

(10) Patent No.: US 7,349,002 B2
(45) Date of Patent: Mar. 25, 2008

(54) THERMAL TRANSFER FILM AND THERMAL TRANSFER PRINTING APPARATUS

(75) Inventors: Satoshi Kanemaru, Minami-Alps (JP); Hajime Isono, Yamanashi-ken (JP)

(73) Assignee: Nisca Corporation, Minamikoma-Gun, Yamanashi-Ken (JP)

( * ) Notice: Subject to any disclaimer, the term of this patent is extended or adjusted under 35 U.S.C. 154(b) by 161 days.

(21) Appl. No.: 11/020,419

(22) Filed: Dec. 27, 2004

(65) Prior Publication Data

US 2005/0140769 A1 Jun. 30, 2005

(30) Foreign Application Priority Data

Dec. 26, 2003 (JP) ..... 2003-431793
Dec. 26, 2003 (JP) ..... 2003-431888

(51) Int. Cl.
*B41J 2/32* (2006.01)
*B41J 2/325* (2006.01)
*B41J 31/00* (2006.01)

(52) U.S. Cl. ..... 347/171; 347/217

(58) Field of Classification Search ..... 347/217, 347/171

See application file for complete search history.

(56) References Cited

U.S. PATENT DOCUMENTS

| | | | | |
|---|---|---|---|---|
| 5,468,711 | A * | 11/1995 | Suzuki et al. | 503/201 |
| 5,686,382 | A * | 11/1997 | Suzuki et al. | 503/201 |
| 6,290,798 | B1 * | 9/2001 | Onishi et al. | 156/230 |
| 6,368,684 | B1 * | 4/2002 | Onishi et al. | 428/32.6 |
| 6,828,274 | B2 * | 12/2004 | Onishi et al. | 503/227 |
| 6,890,623 | B2 * | 5/2005 | Onishi et al. | 428/195.1 |
| 2002/0000286 | A1 * | 1/2002 | Onishi et al. | 156/234 |
| 2002/0150701 | A1 * | 10/2002 | Onishi et al. | 428/29 |

FOREIGN PATENT DOCUMENTS

| | | |
|---|---|---|
| JP | 57-210872 | * 12/1982 |
| JP | 08-224973 | 3/1996 |
| JP | 10-324011 | 8/1998 |
| JP | 2001-063893 | 3/2001 |

* cited by examiner

*Primary Examiner*—Huan Tran
(74) *Attorney, Agent, or Firm*—Manabu Kanesaka

(57) ABSTRACT

A card printing apparatus includes an information recording unit for printing an image to a card medium having at least a rewrite printing region capable of repeatedly coloring and deleting of color through application of heat. The information recording unit has a single thermal head for printing the image to a rewrite printing region and an individual information printing region where the coloring and deleting of color are not performed.

15 Claims, 12 Drawing Sheets

THERMAL TRANSFER FILM AND THERMAL TRANSFER PRINTING APPARATUS

BACKGROUND OF THE INVENTION AND RELATED ART STATEMENT

The present invention relates to a thermal printing apparatus for printing information such as images and letters to a recording medium such as a card, and a thermal transfer film for the thermal printing apparatus. More particularly, the present invention relates to a thermal printing apparatus capable of re-writing information such as letters or numbers with a thermo-reversible printing method, and a thermal transfer film for the thermal printing apparatus.

Conventionally, when a card-shaped recording medium such as a credit card, cash card, license card, and ID card is produced, a thermal transfer type printing apparatus is used for thermally transferring a desired image and letter to a recording medium via a thermal transfer film with a thermal transfer head. Such a printing apparatus with the thermal transfer method is disclosed in Japanese Patent No. 3330355. In the thermal transfer method, a thermal sublimate ink is used because of superior color tones and high quality images. Therefore, the thermal transfer method is effective for printing a photograph.

Recently, an over-write card or rewritable card has been used as a point card, prepaid card, or leisure card in which data such as a number or letter can be repeatedly printed and written. A printing apparatus (reader/writer) capable of re-writing data with a thermo-reversible printing method has been disclosed in Japanese Patent No. 3125247.

There has been a credit card (for example IC cards) having a rewritable display data region in the market (for example, a fine rewrite IC card manufactured by TOPPAN FORMS Co., Ltd.). In such a card, dyes and a developing agent are formed in layers in the display data region for providing color. For example, Japanese Patent Publication (Kokai) No. 08-224973 has disclosed a card with a face and individual information such as a name of an owner. Also, numbers are printed in a rewritable display data region on the card.

In a printing apparatus with the thermal transfer method mentioned above, a plastic film such as a polyester film is used as a base sheet for a thermal transfer film for printing an image or letter. According to an application, the thermal transfer film includes a sublimate type thermal transfer film in which a dye layer formed of a thermal sublimate dye and a binder such as a resin is formed on a surface of a base sheet, and a thermal transfer film in which an ink layer formed of a coloring agent such as paint and a hot-melt compound is formed instead of the dye layer. A heating device such as a thermal head applies thermal energy corresponding to an image from a backside of the thermal transfer film, so that an ink component is sublimated or melt. Accordingly, the ink component is transferred to a medium such as a card or plastic sheet, thereby forming an ink image of a letter or an image.

When personal information of an owner is printed, and a letter or an image is printed in the display data region on the card, it is necessary to provide a printing apparatus for printing the individual information of the owner and another printing apparatus for printing the image in the display data region, thereby increasing a set up space, cost, and an amount of work, and lowering productivity. If a printing apparatus with a single configuration can print, it is possible to reduce a space and cost while improving productivity.

In a printing apparatus with a thermo-reversible printing method for repeatedly printing and re-writing display data such as numbers and letters, a dye and a developing agent are formed in layers on a card medium for providing color. A heating device such as a thermal head applies thermal energy to the card medium to form display data such as numbers and letters. Accordingly, it is not necessary to use the thermal transfer film described above.

In view of the situation described above, an object of the present invention is to provide a thermal transfer printing apparatus capable of reducing an installation space and cost and improving convenience for an operator for issuing a card medium.

Another object of the present invention is to provide a thermal transfer film for a printing apparatus for irreversibly printing individual information of a card owner and reversibly printing in a display data region on a card medium, thereby performing an appropriate printing process.

Further objects and advantages of the invention will be apparent from the following description of the invention.

SUMMARY OF THE INVENTION

In order to attain the objects described above, according to a first aspect of the present invention, a thermal transfer printing apparatus includes a printing device for printing an image onto a card medium. The card medium has at least one portion with a first printing region in which coloring and deleting of color can be repeated through application of heat. The printing device comprises a single thermal head for printing an image in the first printing region and a second printing region in which coloring and deleting of color can not be repeated.

In the first aspect of the present invention, the thermal transfer printing apparatus includes the printing device for printing the image onto the card medium. The card medium has at least one portion with the first printing region in which coloring and deleting of color can be repeated through application of heat. The printing device comprises the single thermal head for printing the image in the first printing region and the second printing region in which coloring and deleting of color can not be repeated. In the first aspect, the printing device comprises the single thermal head for printing the image in the first printing region in which coloring and deleting of color can be repeated and the second printing region in which coloring and deleting of color can not be repeated. Accordingly, it is possible to reduce a space and cost of the thermal transfer printing apparatus. Further, it is possible to print in the first and second printing regions with the single thermal transfer printing apparatus, thereby improving convenience for an operator.

In the first aspect of the present invention, when a dye is formed (layered) in a layer in the first printing region of the card medium for providing a color, the thermal head directly applies heat to the card medium for printing the image in the first printing region. In this case, it is not necessary to dispose a thermal transfer film. Accordingly, the thermal transfer printing apparatus is preferably provided with a transport device for transporting the thermal transfer film with a transfer layer formed on a base film, and a control device for controlling the transport device according to printing of the image in the first printing region and the second printing region with the thermal head.

The control device controls the transport device according to a type of thermal transfer film. For example, when the thermal transfer film has the transfer layer intermittently formed on the base film, the control device may control the transport device so that a portion of the base film without the transfer layer on the thermal transfer film is disposed between the thermal head and the card medium when the thermal head prints the image in the first printing region.

In this case, the thermal transfer film may have a detection member adjacent to the portion of the base film for detecting the portion. The thermal transfer printing apparatus may further include a detection device for detecting the detection member. When the detection device detects the detection member, the control device may control the transport device to position the portion of the base film when the thermal head prints the image in the first printing region.

The thermal transfer film may have a first transfer layer having a thermal sublimate ink layer or a thermal fusion ink layer and a second transfer layer with substantial transparency alternately formed on the base film. In this case, the control device may controls the transport device, so that a portion of the base film with the second transfer layer to be transferred to the second printing region by the thermal head is disposed between the thermal head and the card medium before the thermal head prints the image in the first printing region.

The detection device may comprise a light emitting element and a light receiving element arranged at positions to sandwich the thermal transfer film. The control device may control the transport device to position a leading edge of the portion of the base film when the thermal head prints the image in the first printing region if the thermal sublimate ink or thermal fusion ink arranged adjacent to the portion blocks light from the light emitting element and the light receiving element does not receive light.

The thermal transfer printing apparatus may further include a judging device for judging whether a transfer processing range in the second printing region where the second transfer layer is transferred with the thermal head is larger than a printing process range in the first printing region. When the judging device judges the transfer processing range is larger, the thermal head transfers the second transfer layer to the second transfer region and prints in the first printing region with the portion of the base film at the same time.

The thermal transfer film may have a transfer layer having at least one of a thermal sublimate ink or thermal fusion ink arranged on the base film. In this case, the thermal transfer printing apparatus may further include a thermal transfer film retracting device for retracting the thermal transfer film from a printing position when the thermal head prints the image in the first printing region. The thermal transfer printing apparatus may further include a card turning device arranged adjacent to the thermal head for turning over the card medium so that the card medium is transported to the thermal head.

In the first aspect of the present invention, the thermal transfer printing apparatus may further include an image deleting device for deleting the image printed in the first printing region by applying heat. The thermal head may have a heating element at a leading edge thereof, so that the thermal head constitutes the image deleting device. The image deleting device may be formed of a heat roller embedded with a heat source.

In the first aspect of the present invention, the printing device prints the image in the first printing region in which the deleting of color and the coloring of the image formed on the card medium can be repeated by applying heat or in the second printing region in which the deleting of color and the coloring can not be repeated. The printing device is formed of the single thermal head. Therefore, it is possible to reduce a space and cost of the thermal transfer printing apparatus. Further, the single thermal transfer printing apparatus prints in the first and second printing regions, thereby improving convenience.

According to a second aspect of the present invention, a thermal transfer film with a belt shape is used for a thermal transfer printing apparatus with a thermal head to form an image on a card medium through application of heat. The thermal transfer film has a plurality of sections with transfer layers transferable to the card medium and a single section without a transfer layer. The plurality of the sections with the transfer layers and the single section without the transfer layer are arranged alternately.

In the second aspect of the present invention, the thermal transfer film with a belt shape is used for the thermal transfer printing apparatus with the thermal head to form the image on the card medium through application of heat. The thermal transfer film has the plurality of the sections with the transfer layers transferable to the card medium and the single section without the transfer layer. The plurality of the sections with the transfer layers and the single section without the transfer layer are arranged alternately. Accordingly, it is possible to consecutively perform one printing process in which individual information of a card owner such as a face and name are irreversibly printed on the card medium using the plurality of the sections with the transfer layers, and another printing process in which a number is reversibly printed on the card medium using the single section without the transfer layer.

In the second aspect of the present invention, the plurality of the sections may include at least one transfer sublimate ink layer and/or thermal fusion ink layer, and a substantially transparent protective layer for protecting a surface of the card medium with the image formed with ink of the ink layer. The transfer sublimate ink layer and/or thermal fusion ink layer and the transparent protective layer are arranged continuously. The ink layer may have a plurality of thermal sublimate ink layers and a single thermal fusion paint layer arranged consecutively. In this case, the single section without the transfer layer may have a base member continuously formed in a bottom layer and commonly shared with the plurality of the sections with the transfer layers. A detection member for detecting a position may be disposed between the plurality of the sections with the transfer layers and the single section without the transfer layer.

In the second aspect of the present invention, the thermal transfer film with a belt shape is used for the thermal transfer printing apparatus with the thermal head to form the image on the card medium through application of heat. The thermal transfer film has the plurality of the sections with the transfer layers transferable to the card medium and the single section without the transfer layer. The plurality of the sections with the transfer layers and the single section without the transfer layer are arranged alternately. Accordingly, it is possible to consecutively perform one printing process in which individual information of a card owner such as a face and name are irreversibly printed on the card medium using the plurality of the sections with the transfer layers, and another printing process in which a number is reversibly printed on the card medium using the single section without the transfer layer.

According to a third aspect of the present tension, a thermal transfer printing apparatus includes a printing device for printing an image to a card medium by applying heat to a thermal transfer film having a plurality of sections with transfer layers transferable to the card medium and a single section without a transfer layer arranged alternately.

The printing device prints the image in a predetermined printing region on the card medium having a leuco dye and a developing agent while contacting the single section without the transfer layer on the thermal transfer film.

In the third aspect of the present invention, the thermal transfer film has the plurality of the sections with the transfer layers transferable to the card medium and the single section without the transfer layer arranged alternately. The printing device sequentially applies heat to at least one or each section of the plurality of the sections with the transfer layers arranged on the thermal transfer film to print on the card medium. Accordingly, it is possible to perform a printing process in which individual information of a card owner such as a face and name are irreversibly printed on the card medium using the plurality of the sections with the transfer layers. The printing device also applies heat to the predetermined printing region with leuco dye and a developing agent while contacting the single section without the transfer layer on the thermal transfer film, so that the image is printed in the predetermined printing region. These printing processes can be performed consecutively without a plurality of printing apparatus, thereby reducing a space and cost, and improving convenience.

In the third aspect of the present invention, the thermal transfer film has the plurality of the sections with the transfer layers transferable to the card medium and the single section without the transfer layer arranged alternately. The printing device sequentially applies heat to at least one or each section of the plurality of the sections with the transfer layers arranged on the thermal transfer film to print on the card medium. Accordingly, it is possible to perform a printing process in which individual information of a card owner such as a face and name are irreversibly printed on the card medium using the plurality of the sections with the transfer layers. The printing device also applies heat to the predetermined printing region with leuco dye and a developing agent while contacting the single section without the transfer layer on the thermal transfer film, so that the image is printed in the predetermined printing region. These printing processes can be performed consecutively without a plurality of printing apparatus, thereby reducing a space and cost, and improving convenience.

BRIEF DESCRIPTION OF THE DRAWINGS

FIGS. 6A to 6C are front views showing an operation of the thermal head, wherein FIG. 6A shows the thermal head in a non-active state, FIG. 6B shows the thermal head in a print-idling position, and FIG. 6C shows the thermal head in a printing state;

FIGS. 7A and 7B are schematic views showing an ink ribbon to be used in the card printing apparatus according to the first embodiment of the present invention, wherein FIG. 7A is a plan view of the ink ribbon, and FIG. 7B is a sectional view of the ink ribbon;

FIGS. 8A and 8B are views showing an operation of the card printing apparatus according to the first embodiment of the present invention, wherein FIG. 8A shows an action 1, and FIG. 8B shows an action 2;

FIGS. 9A and 9B are views showing an operation of the card printing apparatus according to the first embodiment of the present invention, wherein FIG. 9A shows an action 3, and FIG. 9B shows an action 4;

FIGS. 12A to 12C are views showing another ink ribbon to be used in the card printing apparatus according to the first and second embodiments of the present invention, wherein FIG. 12A is a plan view of the ink ribbon, and FIGS. 12B and 12C are sectional views of the ink ribbon; and FIGS. 13A and 13B are views showing a further ink ribbon to be used in the card printing apparatus according to the first and second embodiments of the present invention, wherein FIG. 13A is a plan view of the ink ribbon, and FIG. 13B is a sectional view of the ink ribbon.

DETAILED DESCRIPTION OF PREFERRED EMBODIMENTS

Hereunder, embodiments of the present invention will be explained with reference to the accompanying drawings. According to a first embodiment of the present invention, a card printing apparatus prints images on a card to be used as an ID card. A card medium to be used in the card printing apparatus will be explained first.

Figure 1:
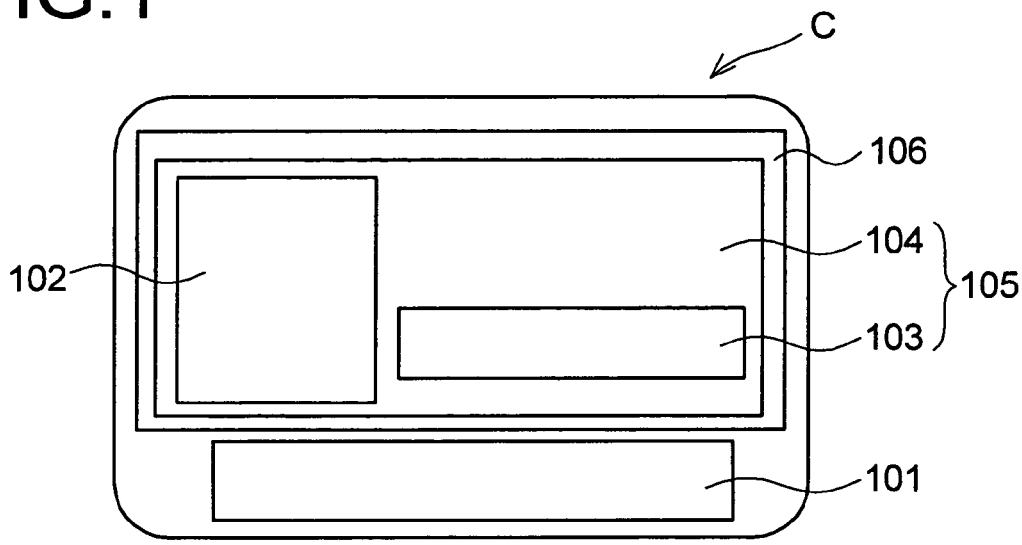
FIG. 1 is a plan view of a card to be used in a card printing apparatus according to a first embodiment of the present invention.

As shown in FIG. 1, a card (blank card) C comprises a rewrite printing region 101 in a strip shape arranged at a bottom as a first printing region that allows repeated deleting of color (erasing) and coloring (printing) through application of heat; and an individual information printing region 105 as a second printing region arranged above the rewrite printing region 101, in which individual information is printed to identify a card holder and does not allow the repeated deleting of color and coloring.

In the embodiment of the present invention, information such as accumulated points, remainder, or card use history is printed in the rewrite printing region 101 using numbers or letters, according to the usage of the card. Also, the individual information printing region 105 is divided into a background printing region 104, an image printing region 102 for printing the photograph of the card owner, and the letter printing region 103 for showing symbols such as letters or a bar code of the card owner name, employee number or membership number.

In the individual information printing region 105, letters and images are printed by a thermal sublimate transfer method (or thermal fusion transfer method) using an ink ribbon R (described later). The individual information printing region 105 is a region for printing information for identification (or specification) of the card owner, so that it is preferable that this region not be capable of being rewritten (such as deleting color using the application of heat), which differs from that of the rewrite region 101. The card C has a protective layer transfer region 106 for protecting the printing surface of letters or images formed in the individual information printing region 105 (the image printing region 102, letter printing region 103, and background printing region 104) using the ink ribbon R (described later). For that purpose, the protective layer transfer region 106 is slightly larger than the individual information printing region 105. Note that according to this embodiment of the present invention, polyvinyl chloride (also known as PVC) capable of receiving a thermal sublimate ink is used for the material of the card C.

Figure 2:
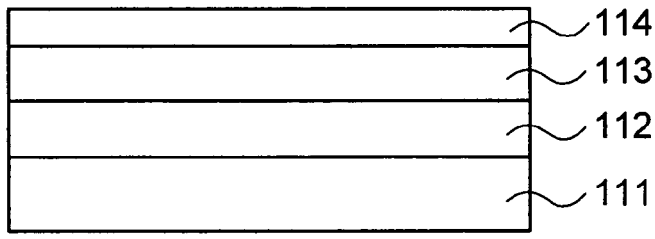
FIG. 2 is a schematic sectional view showing a card rewrite printing region to be used in the card printing apparatus according the first embodiment of the present invention.

As shown in FIG. 2, the rewrite printing region 101 of the present embodiment is sequentially layered with a base (core material) 111 composed of PVC plastic; a transparent or opaque PET film 112; a rewrite later 113; and a protective layer 114 to ensure permanence. It is also perfectly acceptable, depending on the use of the card, to layer in a design layer that is preprinted or colored.

For the rewriting affect with the rewrite printing region 101, a type is used that causes a chemical reaction of the leuco dye and developing agent included in the rewrite layer 113, when thermal energy is applied thereto. Specifically, the colorless leuco dye and developing agent exist separated from each other. When a predetermined temperature (170° C. to 180° C.) is applied, the leuco dye and a developing agent with a property to increase the cohesive force between the molecules and cause coloration of the leuco dye melt, thereby coloring the leuco dye. Then, by rapidly cooling them, they crystallize while being mixed together, thereby maintaining the colored state.

A thermal head 32 (see FIG. 3 and FIG. 4) is used as a configuration for applying heat to the coloring state. By controlling the generation of heat of a plurality of heating elements 32*a* (the main body of the head) that are arranged on the leading end of the thermal head 32 according to the image to be printed, it is possible to print (color) the desired numbers or letters on the rewrite printing region 101. Also, as a general characteristic of the thermal head, the heat generating elements rapidly heat by being charged with electrical energy, and conversely cool rapidly by a interrupting that electrical charge. Therefore, such a thermal head is particularly appropriate for the rewriting action.

The rewriting action shifts from colored state to an original, non-colored state. The crystallized leuco dye and developing agent fused together in a colored state gradually separate by applying heat for a fixed amount of time below a melting point of a predetermined temperature range (120° C. to 140° C.) for both materials. As these materials gradually cools, the crystallized leuco dye returns to its former, colorless state.

In this embodiment of the present invention, a thermal head 32 is used as a configuration for shifting to the colorless state using application of heat. Specifically, the thermal head 32 of this embodiment functions as the image deleting device. In this way, it is possible to repeatedly delete the color (delete) and color (print) in a reversible manner by applying heat from the thermal head 32 on the rewrite printing region 101 with the rewrite layer 113.

The following provides a description of the configuration of the card printer apparatus according to this embodiment of the present invention.

Figure 3:
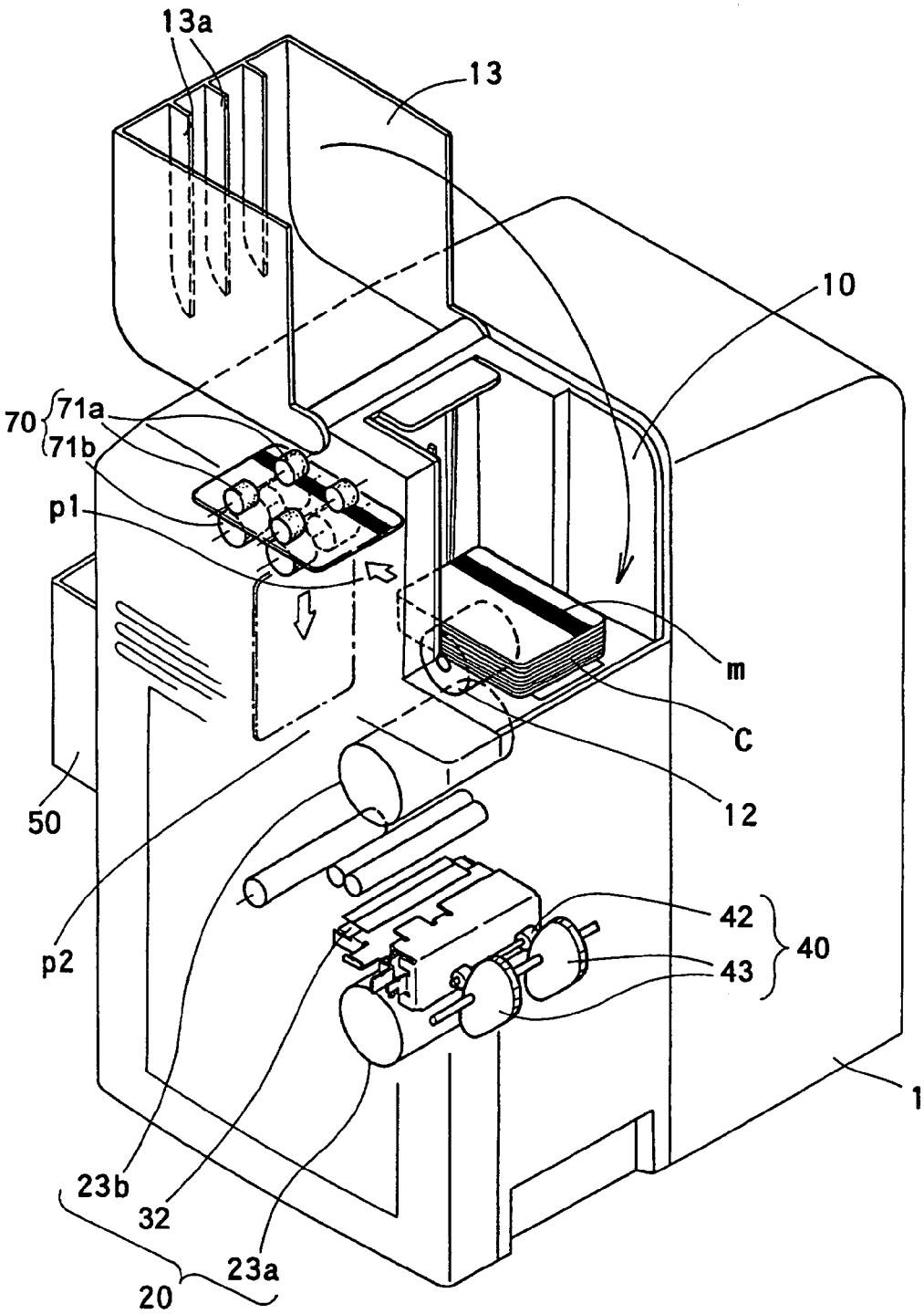
FIG. 3 is a perspective view with partial broken portions showing the card printing apparatus according to the first embodiment of the present invention.
Figure 4:
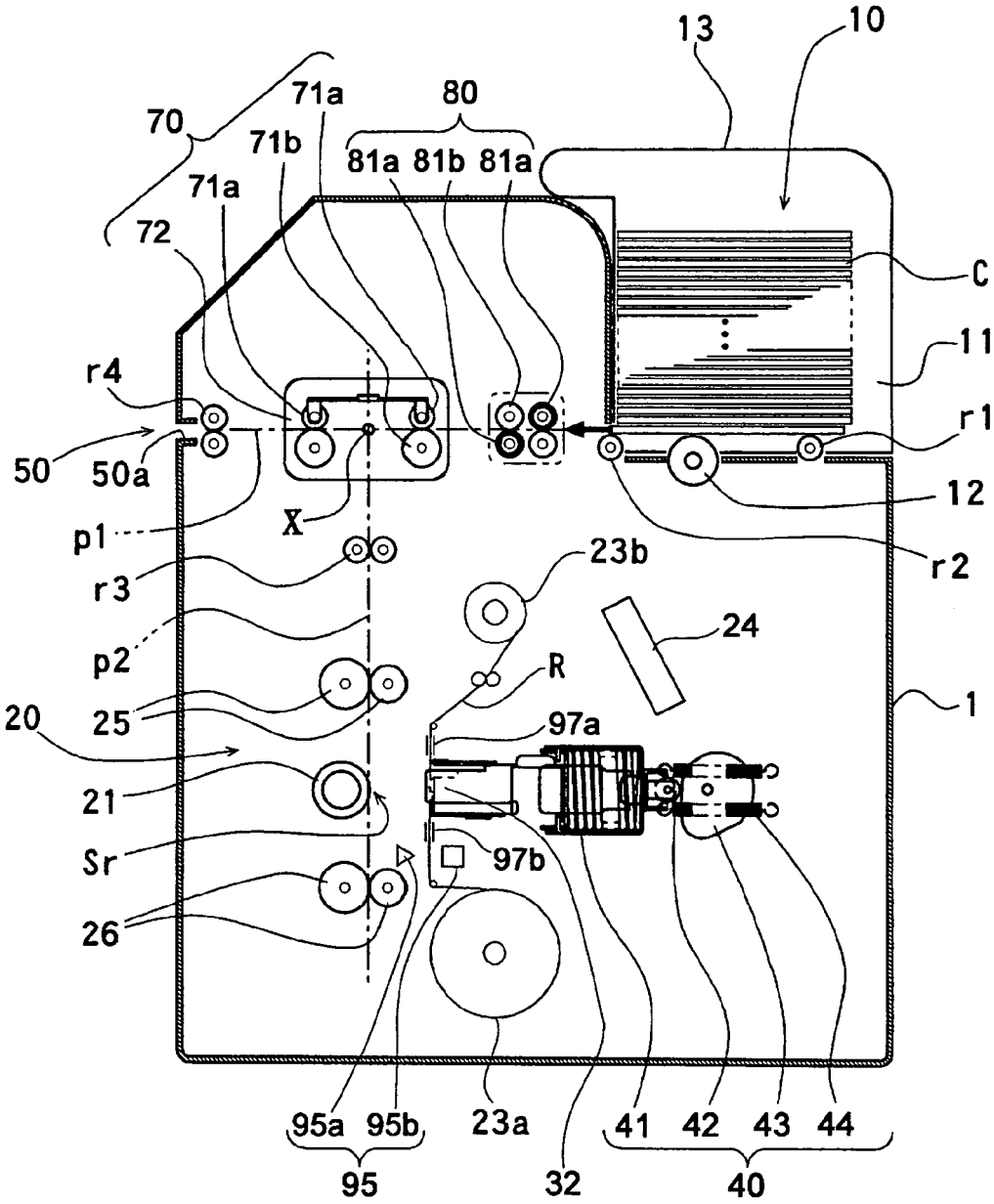
FIG. 4 is a front view of the card printing apparatus according to the first embodiment of the present invention.

As shown in FIG. 3 and FIG. 4, the card printing apparatus 100 of this embodiment comprises, arranged substantially horizontally in a frame 1, a first transport path p1, and a second transport path p2 that is arranged vertically and perpendicular to the first transport path p1.

On the first transport path p1, there are arranged a card supply unit 10 for accommodating blank cards C (card medium) and kicking out one card C at a time; a cleaner 8 disposed at a downstream side of the card supply unit for cleaning the surface of the card C kicked out to the first transport path p1; a card turnover unit 70 as the card turning device for turning over the card C around the intersecting point X of the first transport path p1 and the second card transport path p2; and a card discharge unit 50 disposed at a downstream side of the card turnover unit 70 for discharging the card C handed over from the card turnover unit 70 to outside of the frame. On the second transport path p2, there is arranged an information recording unit 20 as the printing device for recording the various information to at least one side of a card C.

The card supply portion 10 comprises the card stacker 11 that accommodates a stack of a plurality of blank cards C. An opening slot is formed in the card stacker 11 at a position facing the first transport path p1 to allow only one card C to pass therethrough. By rotating a kick roller 12 that touches the card C positioned at the very bottom of a plurality of cards C stacked in the card stacker 11, only one card C is sent to the first transport path p1. Furthermore, guide rollers r1 and r2 are arranged on both sides of the kick roller 12 for guiding the bottommost card C kicked out by the kick roller 12 to be transported substantially horizontally along the first card transport path p1.

An opening lid 13 is arranged above the card stacker 11 to allow the top and side portions of the card stacker 11 to open. One side of the opening lid 13 is rotatably hinged to the top portion of the frame 1 (see FIG. 3). A plurality of card engaging pieces 13*a* that touches the blank card C is formed on the inner side of the opening lid 13. When the opening lid 13 is opened, a plurality of blank cards C (a stack of cards) is filled in a stack inside to the card stacker 11. By closing the opening lead 13, it is possible for the card engaging pieces 13*a* to press against an end of the stack of cards to align their edges.

The cleaner 80 is composed of two pairs of rollers. There are the cleaning rollers 81*a* that are made of a rubber material having an adhesive nature, and pressure rollers 81*b* that press against the cleaning rollers 81*a*. These pairs of rollers sandwich the first transport path p1. Foreign matter such as dust that adheres to both surfaces of the card C that is kicked into the first transport path p1 is removed by the rotation of the cleaning rollers 81*a* arranged above and below that path.

The card turnover unit 70 comprises a pair of pinch rollers 71*a* and 71*b* that nips the card C, and a turning frame 72 that rotatably supports the pair of pinch rollers 71*a* and 71*b* for rotating around the intersecting point of the first transport path p1 and the second transport path p2. The card turnover unit 70 functions to turnover the card C transported to the first transport path p1 to the second transport path p2. In other words, the card turnover unit 70 functions to feed and turnover the card C (to the backside) to freely print to either a single side or both sides using the information recording unit 20.

The pinch rollers 71*a* and 71*b* are in pressing contact to sandwich the first transport path p1 when the turning frame 72 is horizontally positioned, and are in pressing contact to sandwich the second card transport path p2 when the turning frame 72 is vertically positioned. The pinch roller 71*b* is a drive roller. The pinch roller 71*a* is a follower roller. The drive system, not shown (using a stepping motor A which is described in further detail below), is activated to drive in synchronization to the rotation of the turning frame 72 and the pinch rollers 71*a* and 71*b*. When the turning frame 72 is rotated or turned a card nipped between the pinch rollers 71*a* and 71*b*, the pinch rollers 71*a* and 71*b* also rotate, thereby displacing the card C. Accordingly, the pinch rollers 71*a* and

71*b* rotate in the opposite direction for the same amount at the angle when rotating or turning the turning frame 72. Note that it is also perfectly acceptable to independently drive the turning frame 72 and pinch rollers 71*a* and 71*b* to prevent the pinch rollers 71*a* and 71*b* from rotating along with the turning frame 72.

The card discharge unit 50 comprises a pair of discharge rollers r4 for discharging the card C handed over from the card turning unit 72 to outside of the frame 1 when a desired printing process has been completed. The pair of discharge rollers r4 pressingly sandwiches the first transport path p1. Furthermore, the opening 50*a* is formed in the frame 1 on a line extending from the first transport path p1. The opening of 50*a* composes a portion of the card discharge unit 50.

A thermal transfer printer configuration is employed for the information recording unit 20. This unit further comprises a platen roller 21 that is disposed at the recording position Sr on the second transport path p2; the thermal head 32 retractably disposed with regard to the platen roller 21; and the pair of transport rollers 25 and 26 that is synchronized with the printing action of the thermal head 32 to move the card C backward and forward (upwardly and downwardly in FIG. 4) on the second transport path p2 with regard to the recording position Sr. Note that the pair of guide rollers r3 and r5 that guides a card C along the second card path p2 transported substantially vertically is arranged between the card turnover unit 70 and the information recording unit 20 and below the pair of transport rollers 26 on the second transport path p2.

The ink ribbon (thermal transfer film) R with a thermal transfer ink applied interposes the platen roller 21 and the thermal head 32. The ink ribbon R is supplied from the ribbon supply reel 23*a* when recording information (when executing printing which is described below) such as letters or images to the card C traveling along the second transport path p2. This ink ribbon R is wound onto the ribbon take-up reel 23*b* that drives along with the rotation of the pair of take-up rollers 22 while substantially the entire surface touches the leading end of the thermal head 32. At this time, by selectively activating heating elements on the thermal head 32 while pressing the thermal head 32 against the surface of the card C interposed therebetween with the ink ribbon R, the thermal transfer ink components that are on the ink ribbon R transfer to the surface of the card C, thereby forming the predetermined image. Note that a plurality of guide rollers is disposed along the transport path of the ink ribbon R.

A gear, not shown, is mated to the drive side roller shaft of the paired take-up rollers 22. This gear meshes with the gear that comprises a clock plate, not shown, on the same shaft. Near the clock plate, not shown, is arranged the unitized transmissive sensor (not shown) for detecting the rotation of the clock plate to control the amount of take-up of the ink ribbon R. Furthermore, the transmissive sensor 95 is disposed at an upstream side of the thermal head 32 (on the ribbon supply reel 23*a* side) as the detection device composed of a light emitting element 95*a* and light receiving element 95*b* that are disposed to sandwich the ink ribbon R. As described in further detail below, by detecting a mark 120 (see FIG. 7B) disposed for position detection at a predetermined position on the ink ribbon R or based on a state in which a plurality of ink layers on the ink ribbon R transmits or interrupts light from the light in meeting element 95*a*, the leading position of a predetermined portion of the ink ribbon R is positioned with regard to the card c.

As shown in FIGS. 5, and 6A to 6C, the advancing and retracting movements of the thermal head 21 to and from the platen roller 21 are performed by a head advancing drive mechanism 40 that is composed of a holder 41 for detachably holding the thermal head 32, the follower roller 42 mounted to the holder 41, a non-circular cam 43 for rotating while contacting the outer circumference of the follower roller 42, and a spring 44 that presses the holder 41 against the cam 43. This is described in further detail below.

Figure 5:
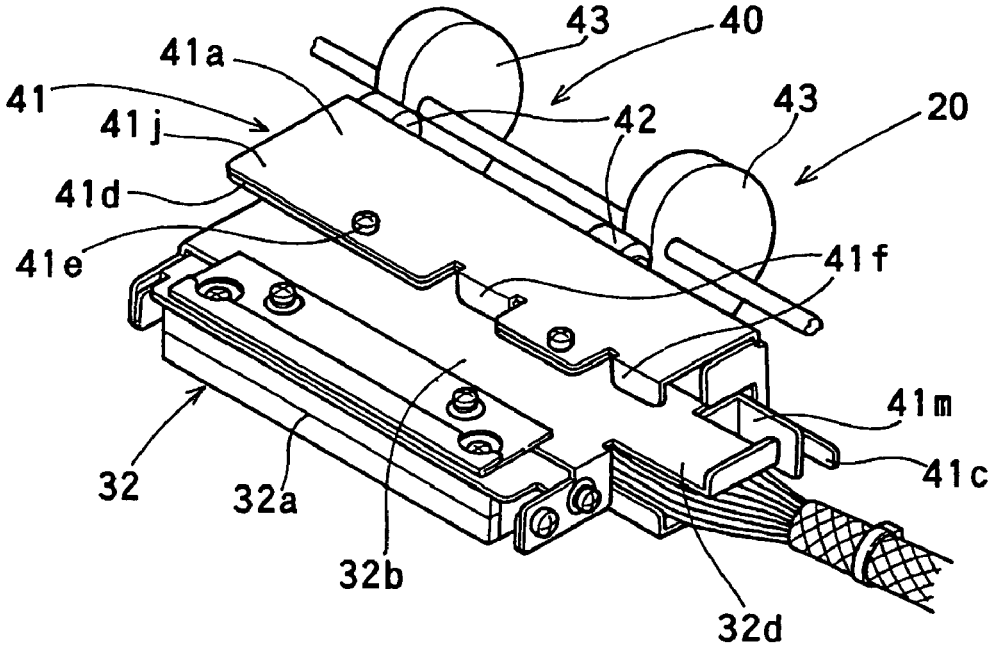
FIG. 5 is a perspective view of a thermal head of the card printing apparatus according to the first embodiment of the present invention.

As shown in FIG. 5, the thermal head 32 is composed as a unit of a plurality of members. Note that the thermal head 32 is mounted to the head holder 41 shown in FIG. 5 via the holder frame 32*b* (the thermal head is mounted to the head holding position). In this state, a stable engagement is obtained for the thermal head 32 at a head holding position while holding an engaging piece, not shown, between pushing members, not shown, that press toward the engaging nail 41*f* of the base frame 41*a*.

To remove the thermal head 32 that is mounted to the head advancing and retracting drive unit 40, in other words when pulling it out from the head of a holding position, an operator nips a finger fastening piece 41*c* and a finger pressing piece 41*m* and pulls the finger pressing piece 41*m* toward the finger fastening piece 41*c*. As a result, a space between the pressing member and engaging nail 41*f* widens, thereby freeing the thermal head 32 from its mounting piece. This makes it possible to pull the thermal head 32 out from the head advancing and retracting drive unit 40 by pulling on the pulling piece 32*d*.

The procedures used to remove the thermal head 32 can be used to replace it with a new one. This method securely positions the thermal head and positions that accurately in the head holding position, thereby ensuring highly precise printing during thermal transfer printing.

The thermal head 32 held in the head holding position takes one of the following states; an non-operating state (see FIG. 6A) in which the ink ribbon R can be removed from the card recording position 100; a print idling position (see FIG. 6B) in which the head main unit 32*a* arranged with a plurality of heating elements at the leading end of the thermal head 32 is positioned near the printing position Sr; and a print execution position (see FIG. 6C) in which the head main unit 32*a* presses against the surface of the card C interposed in between with the ink ribbon R.

Figure 6A:
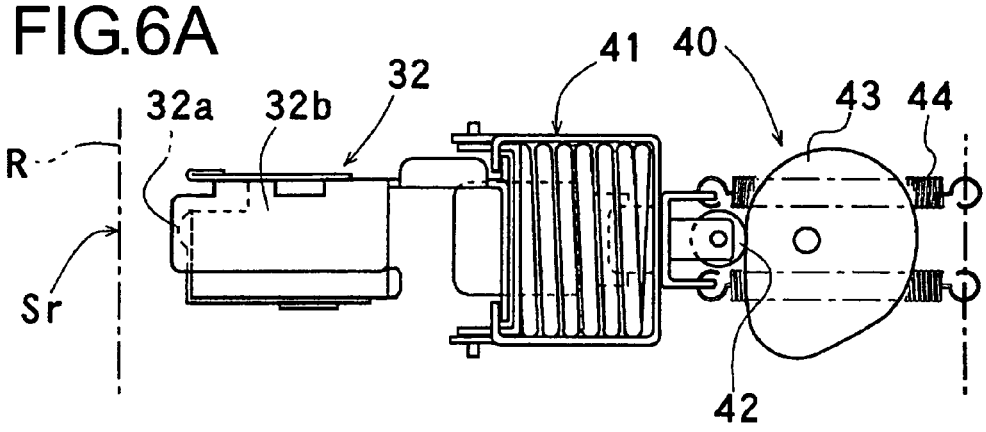
Figure 6B:
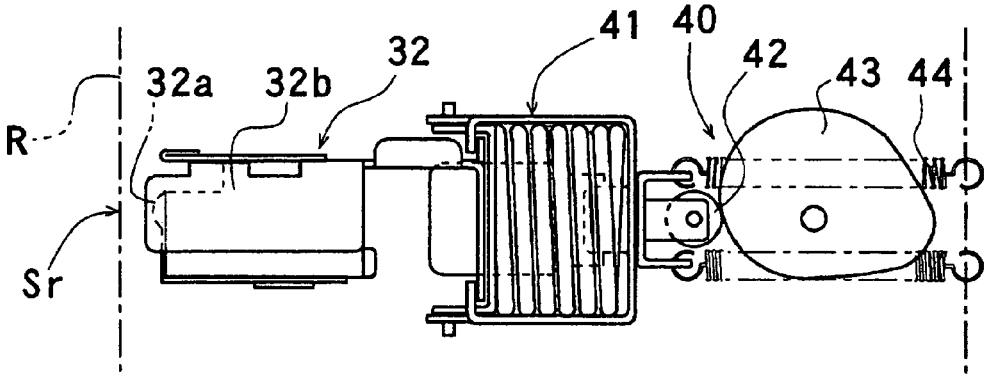

By controlling the rotation of the cam 43, it is possible for the head of the advancing and retracting drive unit 40 to selectively take up one of the three states of the non-operating state, print idling state, and print execution state. In other words, as shown in FIG. 6A, the head main unit 32*a* is positioned farthest away from the ink ribbon R (the printing position Sr) in the non-operating state, in which the cam touches the follower roller 42 with its smallest diameter portion. In this state, the ink ribbon R is unhindered by the thermal head 32, and can thus be allowed from the inside of the card printing apparatus 100 in a right angle direction to the surface of the paper of FIG. 6A. As shown in FIG. 6B, in the print idling state, the cam 43 touches the follower roller 42 with its middle sized diameter, thereby positioning of the head main unit 32 in a position near and away from the ink ribbon R. Thus, the head main unit 32*a* is idled so that it can quickly shift to a position where it can come into contact with the ink ribbon R when the print instruction is received.

Figure 6C:
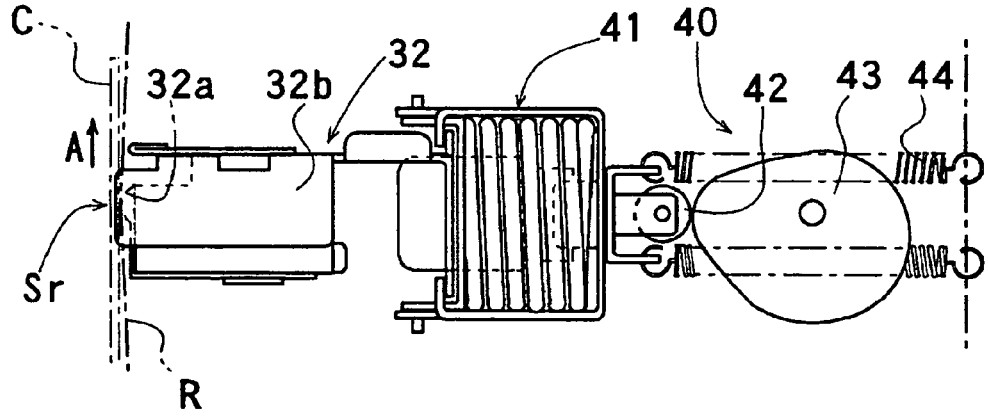

FIG. 6C depicts a print execution state in which the cam 43 touches the follower roller with its largest diameter portion, thereby pressing the head main unit 32*a* against the card C interposed therebetween with the ink ribbon R. In this state, by selectively heating a plurality of heating elements on the head main unit 32*a*, the thermal transfer ink components dispensed to the ink ribbon R are thermally transferred to the surface of the card C, thereby forming the desired image information onto the surface thereof.

In the print execution state, the ink ribbon R and the card C move at the same speed in the direction of the arrow A in FIG. 6B relative to the head main unit 32*a*. When printing is completed and the card C has passed through the printing position Sr, the head main unit 32*a* shifts back to the print idling state as depicted in FIG. 6B. To continue printing images to the card C, the head main unit 32*a* shifts to the print execution state shown in FIG. 6C. In other words, the thermal head 32 repeatedly moves between the print idling state shown in FIG. 6B and the print execution state shown in FIG. 6C unless it is necessary to remove the ink ribbon R.

As shown in FIG. 4, in the information recording unit 20, a fan 24 is disposed near the thermal head 32 to cool the thermal head and its ambient temperature to maintain a predetermined temperature in the environment thereof. The fan 24 acts to rapidly cool the rewrite printing region 101 after coloring the leuco dye of the rewrite printing region 101 using the thermal head 32 to promote crystallization of the developing agent and the leuco dye.

Furthermore, unitized transmissive sensors S1 and S2 for detecting the leading edge and the trailing edge of the card C in the transport direction are disposed near the first transport path p1 between the cleaner 80 and the card turnover units 70, and near the second transport path p2 between the pair of guide rollers r3 and the pair of transport rollers 25, respectively.

The card printing apparatus 100 is driven by the power of five stepping motors capable of both forward and reverse drives. Specifically, the kick roller 12 of the card supply unit 10 and the turning frame 72 of the card turn over unit 70 are driven by a stepping motor A (hereinafter referred to as motor A), not shown. The pressing roller 81*b* of the cleaner, the pinch roller 71*b* of the card turnover unit 70, and one of the pair of discharge rollers r4 (a drive roller) are driven by a stepping motor B (hereinafter referred to as motor B), also not shown. Also, the pair of transport rollers 25 and 26 and the platen roller 21 are driven by a stepping motor M (hereinafter referred to as motor M), also not shown. In addition, the spool shaft disposed on the center of the pair of take up rollers 22 and ribbon take up reel 23*b* and the spool shaft disposed at the center of the ribbon supply reel 23*a* are driven by stepping motor Y (hereinafter referred to as motor Y). The cam 43 is driven by a stepping motor Z (hereinafter referred to as motor Z). Motor Y and motor Z are also omitted from the drawings. The dynamic force of the motors A and B are transmitted to each of the drive rollers described above via drive transmission system, not shown, and solenoid clutch. Note that the motor Y functions as a part of the transport device for transporting the ink ribbon R (thermal transfer film).

The card printing apparatus 100 comprises, in the frame 1, a control device for controlling the operation of the entire card printing apparatus 100; a control unit 98 as the judging device; and the power unit 99 for converting commercial alternating current power into direct current power that can drive or operate each of the mechanisms and control units.

The control unit 98 comprises a CPU block for control processes of the card printing apparatus 100. The CPU block is composed of a CPU that operates with a fast clock speed as the central processing unit, a ROM that stores control operations for the card printing apparatus 100, a RAM as the working area on the CPU, and an internal bus that connects the components.

The CPU block is connected to the external bus. The external bus is connected to a sensor control unit for controlling signals from each sensor; an actuator control unit for outputting drive pulses to each motor to control the motor driver and the solenoid clutch; a thermal head control unit for controlling the thermal energy of the thermal head 32; an external I/O A interface for communicating with the external computer such as a personal-computer; and a RAM (hereinafter, referred to as the external RAM different from the RAM connected to the internal bus) that stores image information to be printed to the card C. The sensor control unit, actuator control unit, thermal head control units are connected to sensors including sensors S1, S2 and 95*b*, the motor drivers of motors A to D, solenoid clutch (not shown), and the thermal head 32.

Figure 7A:
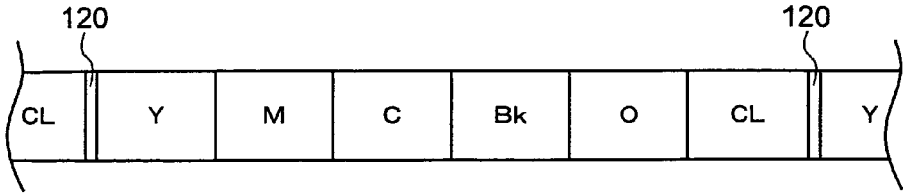
Figure 7B:
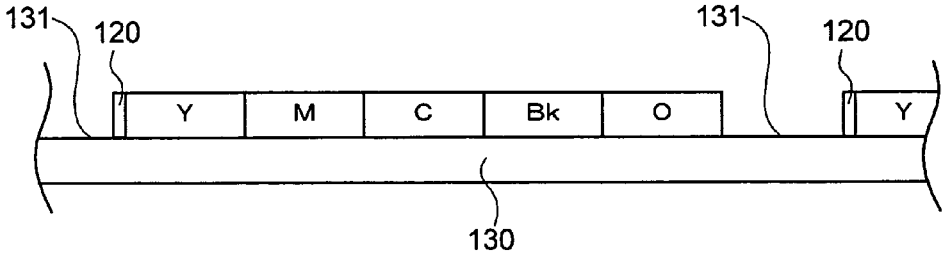

The ink ribbon R used in the card printing apparatus 100 of the embodiment of the present invention will be explained next. As shown in FIG. 7A and FIG. 7B, the ink layers Y (yellow), M (magenta), and C (cyan) containing a sublimate leuco dye, and the ink layer Bk (black) containing a thermal using ink are arranged alternately on the surface of the ink ribbon R. In addition, a substantially transparent protective layer O, the ink layers Y, M, C and Bk, and a clear layer CL on the exposed base portion 131 without the transfer layer similar to the protective layer O are arranged in a pattern on the ink ribbon. In other words, the ink ribbon R comprises, on the base film 130, the ink layer Y, M, C and Bk as the first transfer layer, the protective layer O as the second transfer layer, and the clear layer CL on the exposed base portion 131 with no transfer layer arranged alternately in a belt-shape.

Position detection marks 120 are disposed adjacent to the base portion 131 (clear later CL) with predetermined widths as the detection members for detecting the base portion 131. In this embodiment, a transmissive sensor 95 formed of a light emitting element 95*a* and a light receiving element 95*b* as the detection device for detecting this mark 120 is employed as described above. Therefore, a thermal fusion Bk (black) ink is used for this mark 20.

Note that to make the base portion 131 easier to see in FIG. 7B, it is depicted with an exaggerated in a bold line. FIG. 7B shows a large level difference in the border areas with the protective layer O and base portion 131 (clear later CL) of the mark 120. This is an exaggerated view to facilitate understanding of the concept. In actuality, the thicknesses of each of layers is adjusted considering durability such as the tensile strength of the ink ribbon R, and the overall ink ribbon R is manufactured to be substantially the same thickness by creating different transparent layers not to affect the predetermined printing processes.

The following materials can be used as the base film of the base member 130. Examples are a plastic film such as polyester, polypropylene, cellophane, a saponified co-polymer of ethylene and polyvinyl acetate, polycarbonate, cellulose acetate, polyethylene, polyvinyl chloride, polystyrene, nylon, polyimide, polyvinyl chloride, polyvinyl alcohol, fluorocarbon resin, chlorinated rubber, an ionomer, or paper such as condenser paper, or paraffin paper, or non-woven materials. These can also be used as compounds. A thickness of the base film 130 can be determined in consideration of the required strength and the thermal conductivity, and normally, a thickness of between 2-10 μm is preferred. It is preferable that the base film 130 have flexibility because the ink ribbon R is transported by guide rollers.

The ink layers of Y (yellow), M (magenta), C (cyan) are layers that bear the sublimate dye with a binder plastic. Any conventionally known dye transfer film that is in use can be provided as a material for use. Specifically, for the different colors, Holon brilliant yellow 6GL, PTY-52, and Macrolex yellow 6G can be used for the yellow dye color; MS Red G, Macrol ex Red Violet R, Ceres Red 7B, Samaron Red HB SL, Resolin Red F3BS can be used for the magenta and dye color; and cayaset blue 714, Wakusolin blue AP-FW, Holon brilliant blue S-R and MS blue 100 can be used for the blue dye color.

The materials used as binders to bear the dye include a cellulose resins such as ethyl cellulose, hydroxyethyl cellulose, hydroxypropyl cellulose, methyl cellulose, cellulose acetate, and ninyl cellulose; a vinyl plastic such as polyvinyl alcohol, poly acetate vinyl, polyvinyl butyral, polyvinyl acetal, polyvinyl pyrrolidone, and polyacrylamide; and polyester. Among the plastics described above in view of durability of heat and shifting of the dye, plastics of a cellulose type, acetal type and butyral type are preferred. Also, in the dye layer that bears the sublimate dye with a binder resin, it is perfectly acceptable to include additives if necessary. A thickness of the dye layer is between 0.2 and 5 μm, preferably 0.4 and 2 μm. The sublimate dye in the dye layer should be 5 to 90% of the mass, and preferably 10 to 70% of the mass.

In the present embodiment described above, a sublimate ink is used in the Bk (black) ink portion. Formed on one side of the base film 130 is a separating layer that is not shown. The ink layer Bk has the sublimate ink layer composed of a coloring agent and vehicle, and if necessary, a variety of additives can be applied. Organic or inorganic paints are preferred for the coloring agent, with a density in the range 5 to 20% of the mass. As a vehicle, for example, wax or plastic can be used as a main component. Other examples of composites with derivatives of drying oil, mineral oil, cellulose and natural rubber, isoprene rubber, butadiene rubber, styrene-butadiene rubber, nitrile rubber, butyl rubber, chloroprene rubber, or acrylic rubber can be provided. As the wax, micro-crystalline wax, carnauba wax, and paraffin wax can be provided. Further, Fischer-Tropsch wax, low-molecular weight polyethylene, tree wax, bee wax, whale wax, Ligustrum ovalifolium wax, wool lanolin, shellac wax, candelilla wax, petrohol lactam, partially degenerated wax, Cetyle esters, cetyleamide, cadeline wax, rice wax, and montan wax can also be employed. The plastic includes acrylic, polyethylene, polyester, Adipic acid, nylon, methacrylic plastic, styrene, vinyl chloride, vinylidene chloride, novolac, olefin, polyacetal, vinyl acetate, and petroleum resin. A thickness of the thermal fusion ink layer Bk can be set to harmonize the necessary concentration and heat sensitivity, and in this embodiment, a range of approximately 1 to 10 μm is employed.

A protective layer is formed on the ink ribbon R to protect the surface of the transfer medium, such as a card, formed with letters and images, and to improve its durability to wear and light, weather resistance and whiteness. This protective layer O can be formed of composite plastics, or compounds of composite plastics and waxes. The following materials can be offered as composite plastics to be used in the protective layer O. They are cellulose resins such as ethyl cellulose, hydroxyethyl cellulose, hydroxypropyl cellulose, methyl cellulose, cellulose acetate, and cellulose acetate; and a vinyl plastic such as polyvinyl alcohol, poly acetate vinyl, polyvinyl butyral, polyvinyl acetal, polyvinyl pyrrolidone, and polyacrylamide. Still further, waxes employed in the protective layer are microcrystalline wax, carnauba wax, paraffin wax, Fischer-Tropsch wax, low-molecular weight polyethylene, tree wax, bee wax, whale wax, Ligustrum ovalifolium wax, wool lanolin, shellac wax, candelilla wax, petrohol lactam, partially degenerated wax, cetyle esters, and cetyleamide. An amount of the wax is appropriate at 0.5 to 10 to 100 of the mass of the composite plastic.

It is possible to include substantially transparent, organic or inorganic granules in the protective layer O. By including these granules, the cutting of the film of the protective layer O is improved, and while the durability to wear of this protective layer O is improved, a matted finish of the surface that suppress the luster of the surface of the protective layer O is also attained. Materials with comparatively highly transparent properties, such as silica, powdered Teflon, and powdered nylon can be offered as examples of granules for use. The amount of granules is appropriate at 0.1 to 10% of the mass of the composite plastic. Note that if the amount exceeds 10%, the transparency and durability of the protective layer O can decrease. Also, by including additives such as a UV absorbing agent, oxidizing preventative, or fluorescent light enhancing agent, the luster, durability to light, weather resistance, and whiteness can be improved for the images covered by the protective layer O after transfer.

As a method for forming the protective layer on the base film 130, an ink is prepared by mixing a synthetic resin with additives such as static electricity prevention agents and wax as required, and the ink is affixed and dried to the film using a known method such as a gravure coat, gravure reverse coat, or roll coat. A thickness of the protective layer O is 0.5 to 5 μm, preferably 1 to 2 μm.

The following shall describe operations of the card printing apparatus 100 according to the embodiment of the present invention in reference to FIG. 8A, FIG. 8B, FIG. 9A, and FIG. 9B. The description shall focus on the CPU of the control unit 98 and proceed in the order of (A) a process for creating (issuing) an ID card; (B) a process for deleting letters printed to rewrite the printing region 101 on the issued ID card; and (C) a process for rewriting letters in the printing region 101 on the issued ID card. Note that a portion of the configuration shown in FIG. 4 is omitted in FIG. 8A, FIG. 8B, FIG. 9A, and FIG. 9B.

(A) Issuing Process

The CPU receives image information (for example color bit maps) to be printed to an image printing region 102, a letter printing region 103, a background printing region 104, and a rewrite printing region 101; letter information (such as black-and-white bitmaps); and printing information (for example black-and-white bit maps) from an external computer and stores them in an external RAM.

Next, when the preprocess instruction is received from the external computer, the CPU gives priority to image information to be printed to the image printing region 102, and combines the image information to be printed to the image printing region 102 with the image information to be printed to the background printing region 104. Then, the CPU executes an image information combining process to store this in the external RAM as image information to be printed to the individual information printing region 105. At this time, the image information of the background printing region 104 remains unchanged, and no consideration is given to the letter information that is printed to the letter printing region 103. As a pre-process, the CPU references header information (the size of individual information printing region 105) of the individual information printing region 105. The CPU then executes a protective region calculation process for calculating sizes and positions of the protective transfer region 106 that are larger than the individual information printing region 105 and smaller than the card size and stored in RAM. Note that it is also perfectly acceptable for an external computer to perform these image information composing process and protective region calculating process.

Furthermore, the pre-process executes a process for converting composite image information, letter information, and print information, and reads out from the external RAM information to be printed to the individual information printing region 105 (excluding letter information printed to the letter printing region 103) into thermal energy for each of the colors of Y, M and C according to the heat characteristics of the individual information printing region 105. Print information to be printed to the letter printing region 103 is converted into thermal energy in black-and-white according to the heat characteristics of the individual information printing region 105. Printed information to be printed to the rewrite printing region 101 is converted into thermal energy in black-and-white according to the heat characteristics of the rewrite printing region 101. In this process, these are stored in the external RAM. Note that the amount of thermal energy from the thermal head 32 when printing to the rewrite printing region 101 (when coloring) via the clear layer CL (Base portion 131) is converted to an amount of thermal energy equivalent or slightly higher than the thermal energy when transferring the Bk ink layer of the ink ribbon R to the letter printing region 103.

Figure 8A:
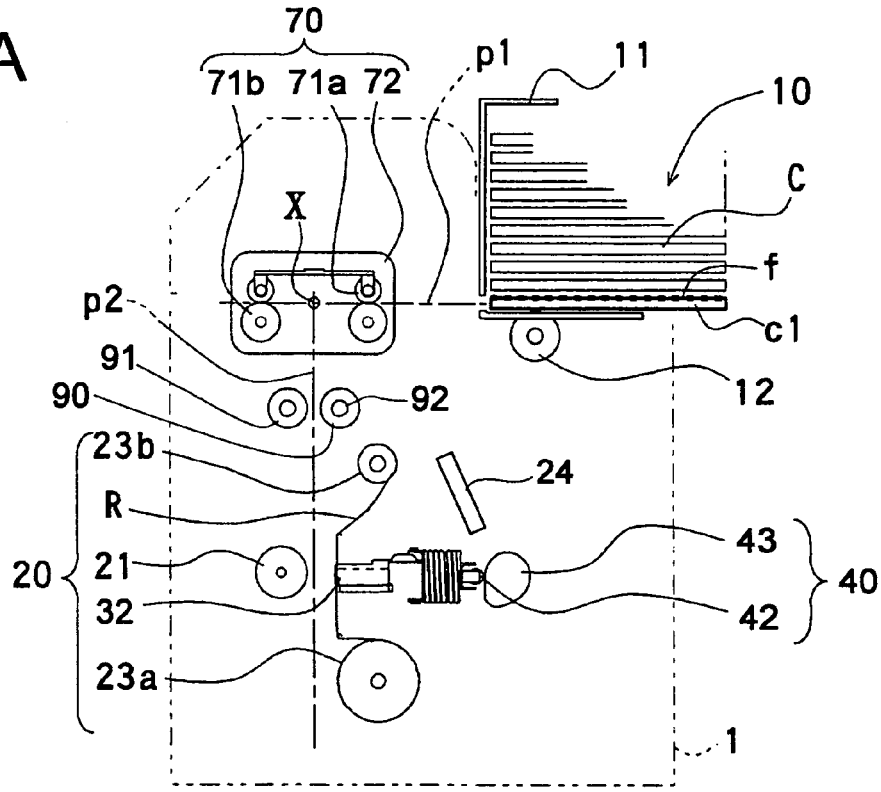

When there is a print instruction, the CPU turns on a solenoid clutch to transmit the rotational drive force of the motor A to the kick roller 12, and turns on another solenoid clutch to transmit the rotational drive force of the motor B to the pressing roller 81*b* of the cleaner and the pinch roller 71*b* of the card turnover unit 70. This causes the kick roller 12 to rotate, thereby taking out only the lowermost card c1 as a target for recording from the card stacker 11. It travels along the first transport path p1 and is transported to the card turnover unit 70 via the cleaner 80. FIG. 8A shows a state prior to the card c1 being kicked out. Note that in FIG. 8A, a surface f (top side) of the card c1 targeted for recording is represented by dots, for reference. The surface f of the card c1 is represented in the same way in FIG. 9A.

After the leading edge of the card c1 is detected by the unitized transmissive sensor S1 arranged between the cleaner 80 and the card turnover unit 70, the CPU turns off the solenoid clutch when the motor A has been driven by a predetermined number of pulses to stop a rotation of the kick roller 12. Also, when the trailing edge of the card c1 is detected, the CPU turns off the other solenoid clutch to stop the rotation of the pressing roller 81*b*.

Figure 8B:
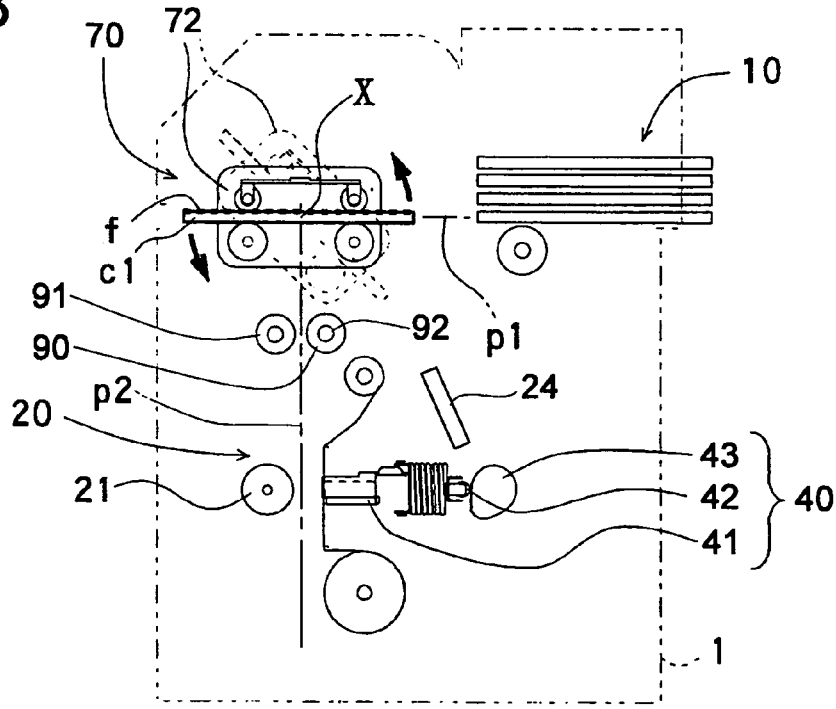

When the card c1 moving along the first transport path p1 is fed until its center reaches the intersection point X of the first and the second transport paths, the CPU turns on another solenoid clutch to transmit the rotational driving force from the motor A to rotate the turning frame 72 around the intersecting point X, as shown in FIG. 8B. Note that in FIG. 8B, it is assumed that the card surface f is printed, and the turning frame 72 is rotated in the counterclockwise direction by 270° degrees. It is also perfectly acceptable to rotate by 90 degrees in the opposite direction of the arrows in the clockwise direction.

Figure 9A:
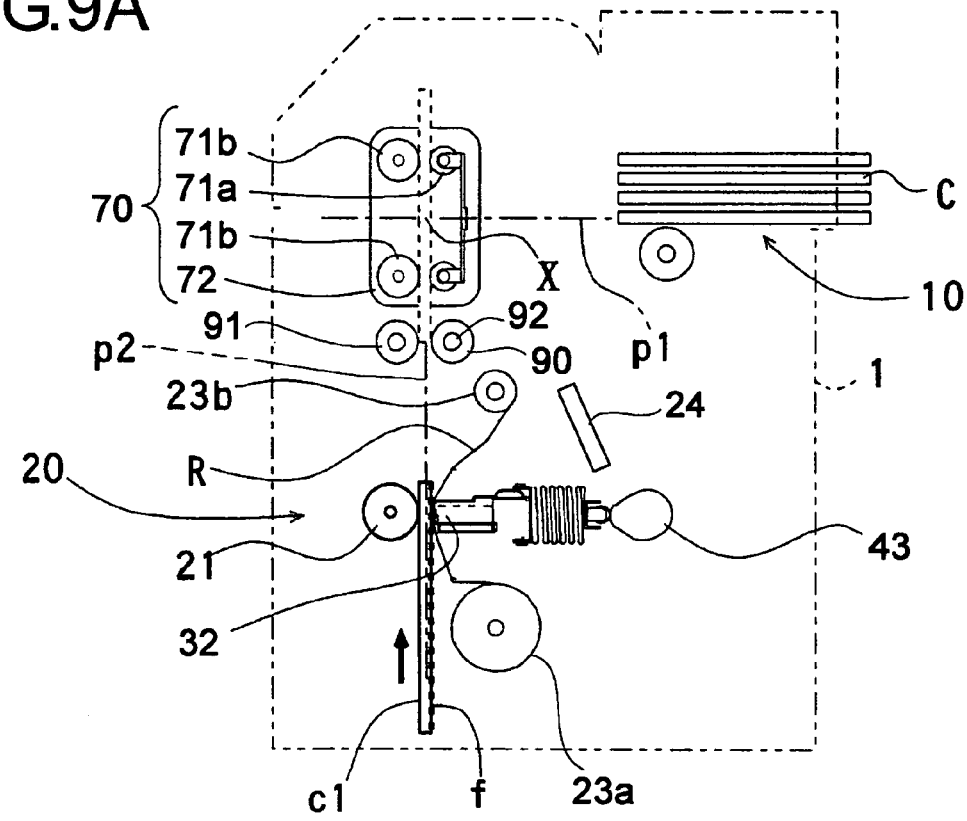

A sensor, not shown, monitors whether the turning frame 72 has rotated by 270° degrees in the direction of the arrow as shown in FIG. 8B and the card cl is parallel with the second transport path p2. When the turning frame 72 is rotated by 270° degrees, the CPU drives the motor M that rotates the pair of transport rollers 25 and 26 and the platen roller 21 that are arranged on the second transport path p2, and turns on another solenoid clutch to transmit the rotational drive force of the motor B to the pinch roller 71*b*, thereby feeding the card c1 toward the information recording unit 20 (see a hidden line state in FIG. 9A). As shown in FIG. 9A, the feeding of the card c1 from the card turning unit 70 to the information recording unit 20 is completed when the card c1 recording starting point (the top edge of the card c1 shown in FIG. 9A) has reached the recording position Sr. It is possible, for example, to determine a position of the card c1 by counting the number of pulses of the motor M after the trailing edge of the card cl transported over the second transport path p2 is detected by the unitized transmissive sensor S2 arranged between the pair of guide rollers r3 and the pair of transport rollers 25.

The following printing processes are executed on the card c1. Printing processes are executed in the following order.

(1) printing to the individual information printing region 105;

(2) printing to the letter printing region 103; (3) transferring of the protective layer O to the protective layer transfer region 106; and (4) printing to the rewrite printing region 101.

In the printing process of (1) printing to the individual information printing region 105, initially the motor Y feeds in the direction to transport the ink ribbon R (the direction to take-up using the ribbon take-up reel 23*b*). When the mark 120 is detected by the transmissive sensor 95, the motor transports the ink ribbon R in the opposite direction to return for a predetermined distance (a predetermined number of pulses to transport the ink ribbon R using the motor Y) to position the leading edge position of the ink layer Y to oppose the thermal head 32.

Next, by driving the motor Z, the cam 43 is rotated. This moves the thermal head 32 that is in the print idling state toward the card c1 to shift to the print execution state. With this process, the thermal head 32 presses the ink layer Y of the ink ribbon R against the card surface f. In this state as the card c1 is moving toward the card turnover unit 70 (see the arrow in FIG. 9A), the heating elements (the head main unit 32*a*) of the thermal head 32 are selectively heated according to the converted amount of thermal energy of Y that is stored in the external RAM thereby causing the ink component of the ink layer Y of the ink ribbon R to sublimate the ink onto the surface of the card c1 (to form an image). Note that when printing using the ink layer Y is completed, the thermal head shifts from the print execution state to the print idling state by driving the motor Z to prepare for the next printing (printing using each of the layers ink ribbon R).

When printing using the ink layer Y is completed, the motor M is driven in reverse until the recording starting point of the card c1 reaches the recording position Sr. The motor Y drives to transport the ink ribbon R so that the leading edge position of the ink layer M is positioned opposite the thermal head 32. Next, the motor Z drives to shift the thermal head 32 to the print execution state, and the thermal head 32 presses the ink layer M against the card surface f. In this state, while the card c1 is moving toward the card turnover unit 70, the heating elements of the thermal head 32 are selectively heated according to the converted amount of thermal energy of M stored in the external RAM, thereby causing the ink component of the ink layer M of the ink ribbon R to sublimate onto the surface of the card c1. In the same way, the ink component of the paint layer C is printed to the surface of the card c1 to end the printing process to the individual information printing region 105. In this way, the three colors of Y, M and C are separated and printed (recorded) as a color image forming an image on the individual information printing region 105 of the card c1.

In the (2) printing process to print to the letter printing region 103, the motor M is driven in reverse until the recording starting point of the card c1 reaches the recording position Sr. The motor Y drives to transport the ink ribbon R so that the leading edge position of the ink layer Bk is positioned opposite the thermal head 32. After that, by driving the motor Z, the thermal head 32 is shifted to the print execution state, and the thermal head 32 presses the ink layer Bk against the card surface f. In this state, while the card c1 is moving toward the card turnover unit 70, the heating elements of the thermal head 32 are selectively heated according to the converted amount of thermal energy of the letter information stored in the external RAM, thereby causing the ink component of the ink layer Bk of the ink ribbon R to sublimate onto the surface of the card c1. Accordingly, the letter information (including symbols) of the card owners name, section, and ID number (company employee number or membership number) are printed (recorded) to the letter printing region 103 of the card c1.

In the process (3) of transferring the protective layer O to the protective layer transfer region 106, the motor M is driven in reverse until the recording starting point of the card c1 reaches the recording position Sr. The motor Y drives to transport the ink ribbon R so that the leading edge position of the protective layer O is positioned opposite the thermal head 32. After that, by driving the motor Z, the thermal head 32 is shifted to the print execution state, and the thermal head 32 presses the protective layer O against the card surface f. In this state, while the card c1 moves toward the card turning unit 70, all heating elements of the thermal head 32 corresponding to the protective layer transfer region 106 are heated according to the size and position information of the protective layer transfer region 106 calculated in the protective region calculation process and stored in the RAM (or sent from an external computer) to transfer the protective layer O to the protective layer transfer region 106 to cover the individual information printing region 105. Accordingly, the printing of the information of the individual owner such as background images, the owners photograph, named, section, and ID number (company employee number or membership number), is protected and overwriting is prevented.

In the printing process (4) of printing to the rewrite printing region 101, the heating elements of the thermal head 32 are heated according to the amount of converted thermal energy of the printer information stored in the external RAM with the clear later CL (base portion 131) interposing the thermal head 32 and card c1 to print (color) the desired numbers or letters to the rewrite printing region 101 of the card c1.

In other words, with the printing process to print to the rewrite printing region 101, first, the motor M is driven in reverse until the record starting point of the card c1 reaches the recording position Sr. Because the protective layer O and the clear later CL (base portion 131) are transparent, before printing, the mark 120 is detected by the transmissive sensor 95 to position the leading end of the clearer layer CL (base portion 131).

Specifically, when the transmissive sensor 95 detects the mark 120, the motor rotates in reverse in the direction to return the ink ribbon R for a predetermined distance to position the leading end of the clear layer CL (base portion 131) to face the thermal head 32. Next, the motor Z drives to shift the thermal head 32 to the print execution state, and the thermal head 32 presses the clear layer CL (base portion 131) against the card surface f. In this state, while the card c1 is moving toward the card turnover unit 70, the heating elements of the thermal head 32 are selectively heated according to the converted amount of thermal energy of the print information that is stored in the external RAM. The leuco dye ink and developing agent exist in a separated state on the rewrite layer 113 formed on the rewrite printing region 101 of the card c1.

As described above, by applying a fixed temperature from the thermal head 32 via the clear later CL (base portion 131) of the ink ribbon R and protective layer 114 formed in the rewrite printing region 101, the leuco dye and developing agent melt together, thereby causing the leuco dye ink to have a color. To promote the rapid cooling effect that fixes the printed numbers and letters on the rewrite printing region 101, the CPU activates the fan 24 at the same time as the heating action caused by the thermal head 32. Through this, information such as accumulated points, remainder, or card use history that corresponds to the type of card use is printed onto the card c1 as numbers or letters.

Figure 9B:
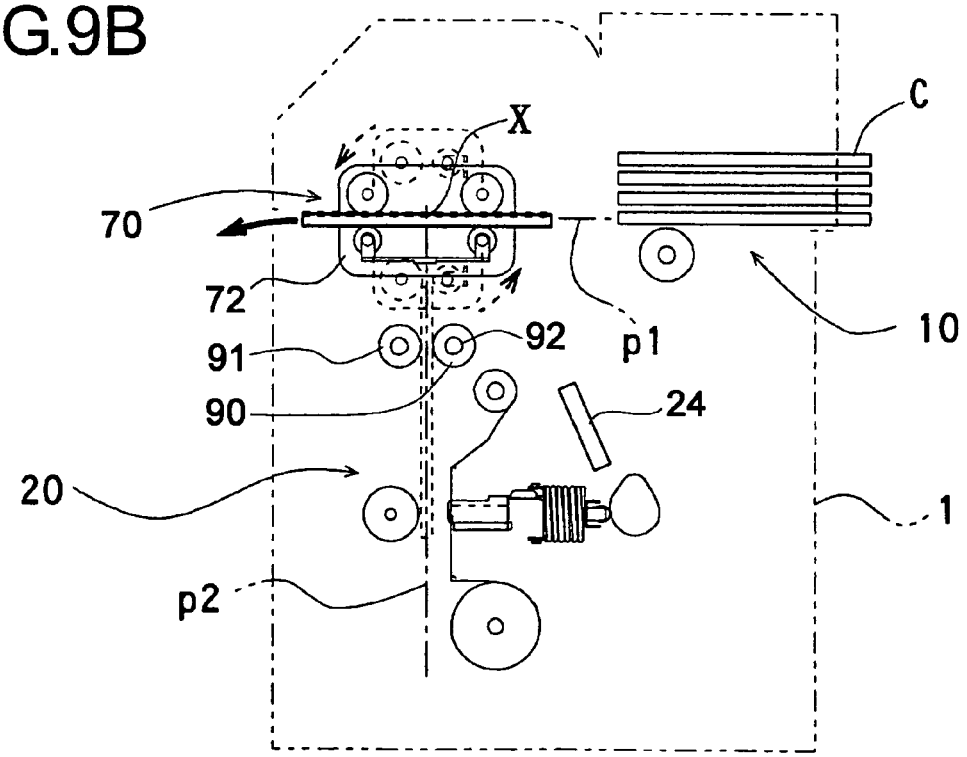

When the printing processes to the card c1 are completed, the CPU drives the motor M in reverse, thereby transporting the card C along the second transport path p2 to the card turnover unit 70, as depicted by a hidden line in FIG. 9B. When the unitized transmissive sensor S2 detects the leading edge of the card c1 traveling along the second transport path p2, a different solenoid clutch is turned on to transmit the rotational driving force of the motor B to the pinch rollers 71*b*. This guides into the central portion of the card turnover unit 70 by being caught with the pinch rollers 71*a* and 71*b* of the vertically oriented card turnover unit 70.

When the center of the card c1 is transported to reach the intersecting point X, yet another solenoid clutch is turned on, and the rotational driving force (reversed direction) from the motor A is transmitted to rotate the turning frame 72 in a counterclockwise direction by 90° degrees while the card c1 is nipped by the pinch rollers 71*a* and 71*b*. (See hidden arrow lines in FIG. 9B.) Next, the CPU turns on another solenoid clutch and still another solenoid clutch to transmit the rotational drive force of the motor A to the pinch roller 71*b* and the pair of discharge rollers r4. Through this, the card c1 passes the opening 50*a* of the trailing edge of the first transport path p1 with the surface f facing upwardly, and is discharged (see the solid arrow in FIG. 9B) to outside of the frame 12, thereby completing the card issuing process.

(B) Deleting Process

Similar to the printing process (4) printing to the rewrite printing region 101 in the issuing process, before the deleting process, the transmissive sensor 95 detects the mark 1202 to position the leading edge of the clear layer CL (base portion 131), so that it opposes the thermal head 32. The motor Z drives to shift the thermal head 32 to the print execution state, and the thermal head 32 presses the clear layer CL against the card surface f. In this state, while the card c2 is moving toward the card turnover unit 70, all of the heating elements of the thermal head 32 that correspond to the rewrite printing region 101 are heated. The leuco dye ink and developing agent are crystallized in a colored state on the rewrite layer 113 formed on the rewrite printing region 101 of the card c2.

As described above, by applying heat of a fixed temperature below the melting point of the leuco dye ink and developing agent from the thermal head 32 via the clear later CL (base portion 131) of the ink ribbon R and the protective layer 114 formed rewrite printing region 101, the leuco dye and developing agent gradually separate, thereby causing the leuco dye ink to return to its original, i.e., the colorless state (deleting the color).

To completely delete the color of the leuco dye ink, the CPU increases the pulse sending intervals of the motor driver that controls the motor M to make the speed of the transport of the card c2 to the card turnover unit 70 (the reverse rotation speed (rpm) by the motor M) in the deleting process lower than the speed of the transport of the card c1 to the card turnover unit 70 (the reverse rotation speed (rpm) by the motor M) in the issuing process (printing process) described above. The CPU controls the thermal head control unit so that the heating temperature (the amount of thermal energy) of all heating elements that correspond to the rewrite printing region 101 are at a fixed temperature below the melting point. Also, the CPU does not activate the fan 24 to prevent rapid cooling of the rewrite printing region 101, which is different from the issuing process. Note that in the deleting process, the transport of the card c2 from the card stacker 11 to the recording starting point (deleting starting point) and the transport of the card c2 to the opening 50*a* after deleting the numbers and letters of the rewrite printing region 101 are the same as those in the issuing process.

(C) Overwriting Process

In the overwriting process, similar to the deleting process described above, the numbers and letters of the rewrite printing region 101 are deleted. The motor M drives to transport the card c2 again to the recording starting point and perform a process same as the process (4) of printing to the rewrite printing region 101. Then, the card c2 is transported to outside of the frame 1 through the opening 50*a*.

A card printing apparatus according to a second embodiment of the present invention will be explained next. In this embodiment, a heat roller is used in the deleting process of the rewrite printing region 101. Note that in this embodiment, the same numbers are denoted to the same components in the first embodiment, and explanations thereof are omitted. Only the different parts are described below.

Figure 10:
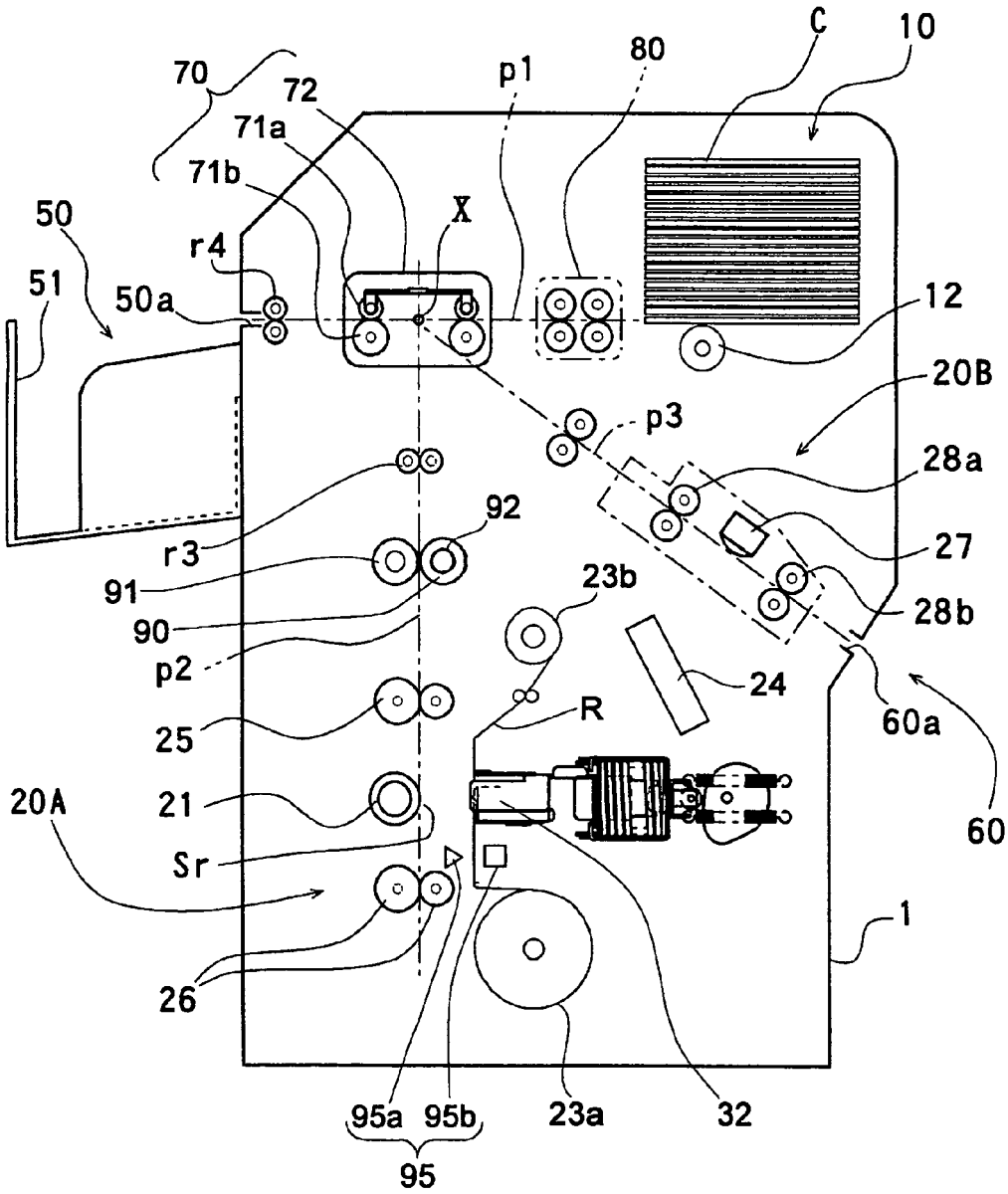
FIG. 10 is a front view showing a card printing apparatus according to a second embodiment of the present invention.

As shown in FIG. 10, a third transport path p3 is obliquely disposed toward the lower side of the card supply unit 10 from the intersecting point X in the card printing apparatus 100' in this embodiment. An information writing head 27 such as a magnetic encoder that magnetically records information to the magnetic strip (see symbol m in FIG. 3) formed on a surface of a card such as a credit card and a second information recording a unit 20B that comprises a pair of transport rollers 28*a* and 28*b* arranged on both sides to nip the information writing head 27 are disposed on the third transport path p3. A pair of guide rollers r6 for guiding the card C to the second information recording unit 20B is disposed between the card turnover unit 70 and the second information recording unit 20B to nip the third transport path p3. Note that the information writing head 27 can be an IC writer terminal unit for writing (recording) information to an IC chip in the card, if the target for recording is an IC card.

Incidentally, when a magnetic encoder writes a variety of information, a card transport in a single pass or in a plurality of passes is performed relative to the information writing head 27 according to a variety of processes such as initializing, magnetically writing, and verifying of a magnetic strip on the card C. In this embodiment, the card C is reciprocated by the rotation (forward and reverse rotation) of a pair of transport rollers 28*a* and 28*b* for transporting the card in the third transport path p3. The rotational driving force of the transport rollers 28*a* and 28*b* can be transmitted from one of the motors A, C, Y or Z described in the first embodiment.

An opening 60*a* is formed in the frame 1 on a line extending along the third transport path p3. The opening 60*a* configures the discard unit 60 for erroneous cards. In other words, when erroneously written information is detected by verifying the written information after writing to the magnetic strip using the information writing head 27, the card is discharged to outside of the frame 1 from the opening 60*a* as an erroneous card. Note that it is also perfectly acceptable to mount a card receptacle at the discard unit 60. A card receptacle 51 is mounted at outside of the opening 50*a* on the card printing apparatus 100' in this embodiment. The card receptacle 51 configures a portion of the card discharge unit 50. Cards that have undergone the prescribed printing process, a deleting process, or an overwriting process are stacked in the card receptacle 51.

Furthermore, a heat roller 90 embedded with a heat source unit 92 such as a halogen lamp, and a platen roller 91 that supports the card C in opposition to the heat roller 90 are obliquely arranged on the second transport path p2 between the pair of guide rollers r3 and the pair of transport rollers 25 in the card printing apparatus 100' in the embodiment. The heat roller 90 and a platen roller 91 function as an image deleting device instead of the thermal head 32 in the first embodiment.

To perform the issuing process with the card printing apparatus 100' in this embodiment of the present invention, a card c1 kicked out from the card supply unit 10 passes through the cleaner 80, and is nipped by the card turnover unit 70 where the card turnover unit 70 is rotated toward the third transport path p3 to feed the card c1 into the third transport path p3. The card c1 is transported to a position where it is nipped by the transport rollers 28*a* and 28*b* of the second information recording unit 20B, where the predetermined information is magnetically recorded to a magnetic strip by the information writing head 27.

Note that the information to be recorded to the magnetic strip is received from the external computer in advance and stored in RAM. Next, a verifying unit, not shown, of the second information recording unit 20B verifies by comparing the information to be recorded to the magnetic strip stored in the RAM with the information recorded on the magnetic strip. If an error is detected in the written information, the card c1 is transported to the discard unit 60 and discharged to outside of the frame 1 from the opening 60*a*. If an error is not detected, the card c1 is transported along the third transport path p3 to the card turnover unit 70.

The card turning unit transports the card c1 to the second transport path p2 while nipping the card c1 written with information on the magnetic strip. The heat roller 90 and platen roller 91 transport the card c1 over the second transport path p2. Subsequent processes, excluding a point where the rotational drive force from the motor M is transmitted, are the same as the issuing process of the first embodiment. In the issuing process, power is not supplied to the heat source unit 92 (lighting the halogen lamp, etc.) of the heat roller 90.

In the deleting process using the card printing apparatus 100' according to this embodiment, power is supplied to the heat source unit 92 of the heat roller 90 as the card c2 is transported along the second transport path p2 while a surface of the card c2 with a comprises rewrite printing region 101 is nipped on the heat roller 90 disposed on the second transport path p2. The generated heat deletes the color of the rewrite printing region 101. Note that the deleting process can be performed in the process for transporting the card c2 (toward a lower side in FIG. 10) toward the information recording unit 20 (thermal head 32) or in the process of transporting the card c2 toward the card turnover unit 70 (toward an upper side in FIG. 10). In consideration of the coloring characteristics of the rewrite printing region 101 that comprises the leuco dye ink, and the heating characteristics of the heat roller 90 (which is not appropriate for rapid heating and rapid cooling), it is convenient to perform the deleting process in the process to transport the card toward the information recording unit 20 (thermal head 32).

The following provides a description of the actions on the card printing apparatuses 100 and 100' according to the first and the second embodiments described above.

The card printing apparatus of the aforementioned embodiment is provided an information recording means 20 for printing images to a card C that comprises a rewrite printing region 101 that allows the repeated deleting of color and coloring through the application of heat. The information recording device 20 comprises a single thermal head 32 for printing images to both a rewrite printing region 101 and an individual information printing region 105 formed on the card C that does not allow repeated the deleting of color and coloring through the application of heat. The card printing apparatus according to the aforementioned embodiments is configured with a single thermal head 32 for printing images to the rewrite printing region 101 (the first printing region) that allows repeated deleting of color and coloring by applying heat and the individual information printing region 105 (the second printing region) that is formed on a card C and does not allow repeated deleting of color and coloring of images formed.

Therefore, the configuration does not require a separate image printing apparatus for printing images to the individual information printing region 105 and the rewrite printing region 101, as conventionally required, and can print to both the individual information printing region 105 and the rewrite printing region 101 using a single card printing apparatus. This increases user (operator) convenience.

Furthermore, a plurality of ink layers of Y, M, C and Bk that can be transferred to the card C, and a single clear layer CL (base portion 131) that does not form a transfer layer are arranged sequentially in order on an ink ribbon R. Therefore, the thermal head 32 of the information recording unit 20 sequentially heats each of the sectioned ink layers of Y, M, C and Bk on the ink ribbon R to perform a printing process for irreversibly printing information of the card owner, and a printing process for reversibly printing to a rewrite printing region 101 by heating the rewrite printing region 101 with the leuco dye ink and developing agent on the card C. Because these can be done consecutively, space for the card printing apparatus is conserved and costs are lowered. Furthermore, because printing to the individual information printing region 105 and rewrite printing region 101 can be done with a single card printing apparatus, user convenience is increased.

Figure 11A:
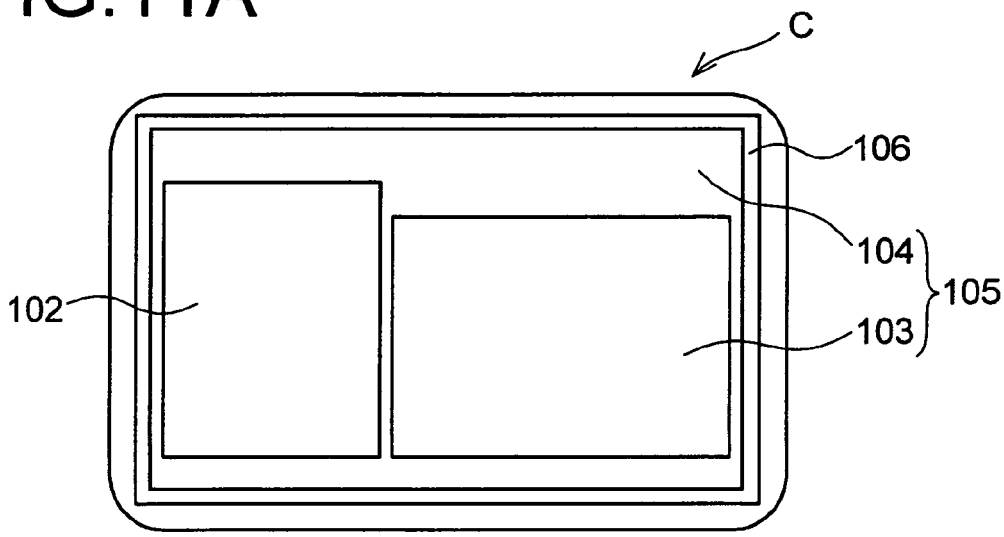
FIGS. 11A and 11B are plan views of another card to be used in the card printing apparatus according to the first and second embodiments of the present invention.
Figure 11B:
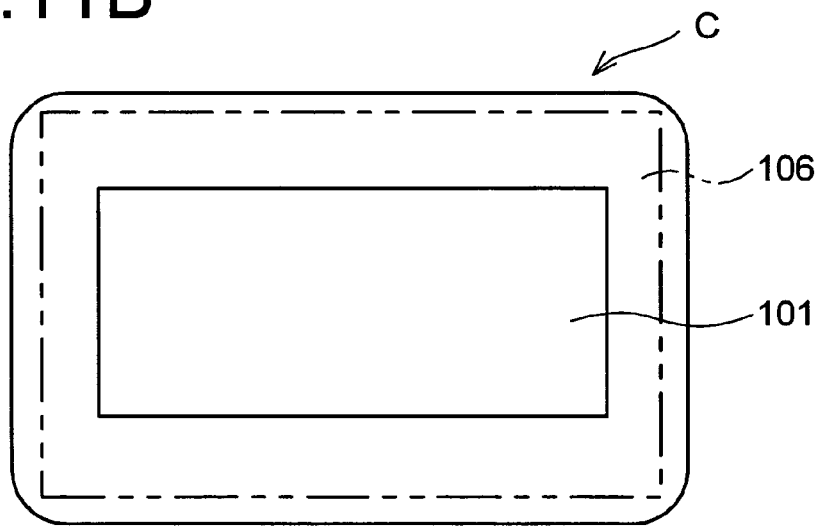

Note that the embodiment described above provides an example of a card C printed with images on one side, as shown in FIG. 1. However, the invention is not limited to that. For example, as can be seen in FIG. 11A and FIG. 11B, the individual information printing region 105 (the image printing region 102, letter printing region 103, and background printing region 104) that does not allow repeated deleting of color and coloring, and the rewrite printing region 101 can be arranged on opposite sides. The card printing apparatus according to the above embodiments comprises a turning unit 70, so that after printing to one side of the card, the card turnover unit 70 can rotate 180 degrees while nipping a card C to allow a printing process to be conducted on the other side of the card C.

Still further, in the above embodiments, an example is provided where the rewrite printing region 101 is arranged on the lower side of the blank cards prior to print recording. However, the present invention is not limited the size or the position of the arrangement.

Still further, embodiments described above provided examples of PVC that is generally used in credit cards, cash cards, license cards, and ID cards that can receive sublimate ink as the material to be used for card C. The invention is not limited thereto, and can also apply polyethylene terephthalate (also known as PET cards) as the material. Such PET cards are gaining attention as a card that is less harmful to the environment and does not generate hazardous materials when the card is incinerated. Because PET is a crystalline material, thermal sublimate transfer is difficult. Therefore, they require a layer that can receive thermal sublimate ink to be applied to their surface. Also, it is difficult to emboss a PET card, so that if it is necessary to emboss the card, a PVC card is used.

The embodiment described above provides an example of heating using the thermal head 32 via a clear later CL (base portion 131) of the ink ribbon R to print to the rewrite printing region 101. It is also perfectly acceptable to employ a configuration for directly heating the card C with the thermal head 32 without interposing an inked ribbon R between the thermal head 32 and card C. For example, as is shown in FIG. 4, when printing to the individual information printing region 105, the letter printing region 103, or the protective layer transfer region 106 of the protective layer O, the ink ribbon holding members 97*a* and 97*b* hold the ink ribbon R to the transport path of the ink ribbon R. When printing to the rewrite printing region 101, the ink ribbon holding members 97*a* and 97*b* retract the ink ribbon R from the transport path of the ink ribbon R. As an actuator for retracting the ink ribbon holding members 97*a* and 97*b* from the transport path of the ink ribbon R, a solenoid can be used. In this configuration, the ink ribbon holding members 97*a* and 97*b* function as the thermal transfer film retracting device.

The embodiment describes an example of the heat roller 90 (the second embodiment) embedded with a thermal head 32 and the heat source unit 92 as the image deleting device. The invention is not limited to this. It is also perfectly acceptable to employ a heated line bar, for example. To heat for a constant time and cool slowly, the heat roller is easier in terms of temperature control.

The aforementioned embodiment provides an example for a direct transfer method using a thermal transfer printer in the information recording unit 20. The invention is not limited to that method, and can employ, for example, an indirect (intermediate) transfer method for transferring an image that is formed once on an intermediate transfer sheet to a card, or another thermal transfer method. Still further, depending on the type of ink, it is possible to employ one of a heat fusing transfer method (for paint type inks) and a thermal sublimate transfer method (for die inks).

Generally, there are a thermal sublimate ink transfer film that is used in a thermal fusion transfer method, a thermal sublimate dye transfer film that is used in a thermal sublimate transfer method, and a transfer film that comprises thermal fusion dye and thermal sublimate dye, as well as a variety of transfer films that are used in well-known transfer methods. These are generally called ink ribbons, and any of those transfer methods can be applied to the thermal transfer film described in the invention.

The thermal fusion transfer method is an image forming method for transferring an ink layer along with a binder to a recording medium such as paper, plastic sheet, or card. This method uses a thermal transfer film that bears a thermal fusion ink layer that is dispersed with coloring such as paint on a thermal fusion wax or plastic binder on a base sheet such as a plastic film (also known as a base film), and applies energy that corresponds to the image information of the heating device such as a thermal head to transfer the image information. In this recording method, the thermal fusion ink is the coloring.

The thermal sublimate transfer method is a method for recording an image. This method uses a thermal transfer film that carries a dye layer that is dissolved or dispersed with a sublimate ink as the coloring on a binder plastic on a base sheet (also known as a base film) such as a plastic film, and a transfer medium that is provided with an image receiving layer on a support body, such as a card. Energy is applied that corresponds to the image information of the heating device such as a thermal head to shift (or transfer) the sublimate dye that is included in the dye layer on the thermal transfer film to an image receiving layer on a transfer medium, thereby recording the image. In this recording method, the dye is the coloring.

Figure 12A:
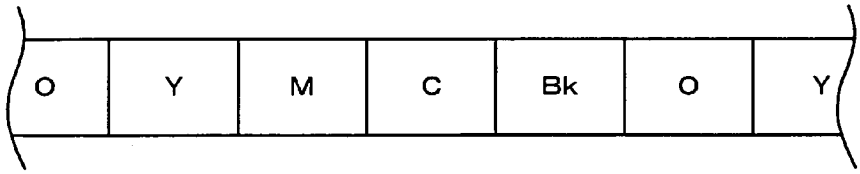
Figure 12B:
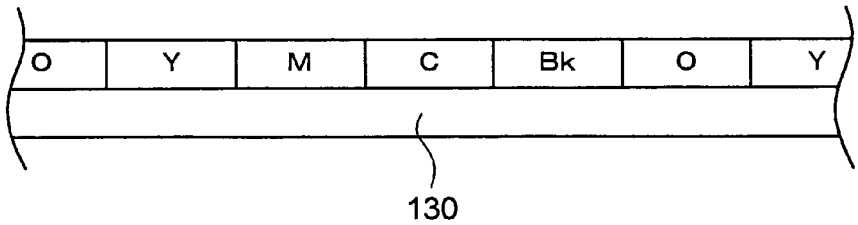
Figure 12C:
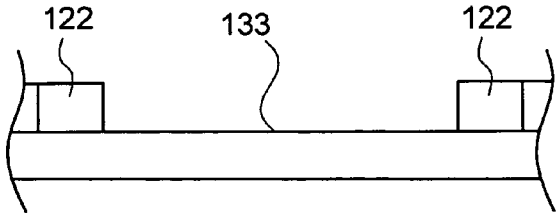

In the embodiment, an example is provided for an ink ribbon R that comprises a clear layer CL (base portion 131), as is depicted in FIG. 7A and FIG. 7B. The invention is not limited to this configuration. For example, the ink ribbon shown in FIGS. 12A to 12C differs from the ink ribbon R shown in FIG. 7A and in FIG. 7B in that it does not have a clear layer CL nor a mark 120. When performing a printing process to the rewrite printing region 101, the base portion 133 with a protective layer O shown in FIG. 12C is used. In other words, with the base portion 133 transferred with a protective layer O interposing the thermal head 32 and the card C, thermal energy is supplied from the thermal head 32, thereby performing the printing process the rewrite printing region 101.

When performing the printing process to a rewrite printing region 101 that is disposed on the other side (backside) of a card, as shown in FIG. 11B, the printing process is continued after the protective layer O is transferred to the protective layer transfer region 106, as shown in FIG. 11A. When the transfer process of the protective layer O is completed, it is acceptable for the base portion 133 with its surface exposed to interpose the thermal head 32 and the card C.

In this case, in order to perform the appropriate printing process (coloring) at the rewrite printing region 101, it is necessary for the transfer region (range for the transfer process) 106 of the protective layer O for which the transfer process is performed just before, to be larger than the printing (printing or coloring) processing range at the rewrite printing range 101, as shown in FIG. 11B. Therefore, the CPU of the control unit 98 judges whether the protective layer transfer region 106 is larger than the right printing region 101 in the protective region calculation process in the previous process described above.

If the region is large or the same size, the CPU controls each portion to perform the transfer process of the protective layer O to the protective layer transfer region 106, and then the printing process to the rewrite printing region 101. If it is smaller, there is the possibility of improper printing in the printing process to the rewrite printing region 101, so that a problem can be reported to an external computer. Note that the number 122 shown in FIG. 12C represents a portion of the protective layer O that remains on the ink ribbon without being used in the transfer process of the protective layer to the protective layer transfer region 106 that occurs first.

The mark 120 is not disposed on the ink ribbon. When the transfer process of the protective layer is completed, the ink ribbon R is transferred in reverse to the return direction, and the transmissive sensor 95 detects the Bk ink layer that is adjacent to the protective layer O. Through this, the ink layer R is transported for a predetermined distance (when the transport of the ink ribbon R is driven by a pulse motor, a predetermined number of pulses) again in the forward direction to position the leading edge position of the base portion 133 of the protective layer to oppose the thermal head 32. In other words, beginning with the ink layer Bk, each of the sections (panels) of the other ink layers of Y, M, C, and the protective layer O are disposed to be slightly larger than the card C surface area, so that in the event that the entire surface of the card C is to be printed, there is always a residual portion of each section. In order to detect the ink layer Bk, light from the light emitting element 95*a* of the transmissive sensor 95 is interrupted by the ink layer Bk, and it is not received by the receiving element 95*b* (based on the status in which light cannot be received), so that the leading edge position can be attained for the base portion 133 of the protective layer.

Figure 13A:
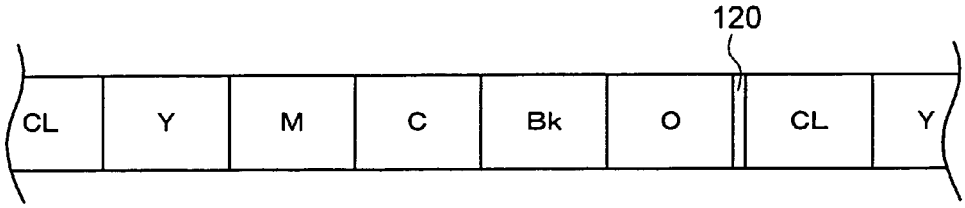
Figure 13B:
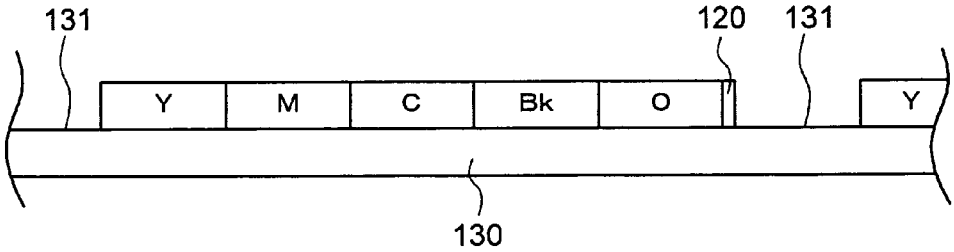

An ink ribbon R shown in FIG. 13A and in FIG. 13B can also be employed. This ink ribbon also has a clear later CL (base portion 131) as does the ink ribbon R shown in FIG. 7A and in FIG. 7B. A position of the mark 120 (between the protective layer O and the clear layer CL) is different. In the embodiment described above, when the mark 120 is detected by the transmissive sensor 95, the ink ribbon R is transported in reverse in the return direction for a predetermined distance to position the leading edge position of the clear layer (base portion 131) in a position that opposes the thermal head 32. The positioning of the leading position of the clear layer CL (base portion 131) on the ink ribbon is possible because a mark 120 is disposed in the front side of the feeding direction of the ink ribbon R. Therefore, when the mark 120 is detected by the transmissive sensor 95, the ink ribbon R continues to be transported in the forward direction for a predetermined distance (when the transport of the ink ribbon R is driven by a motor Y, predetermined number of pulses is used), thereby positioning the leading edge position of the clear layer CL (base portion 131) in a position opposing the thermal head 32. This makes the transport control of the ink ribbon simpler, and shortens the amount of time for the series of the printing processes.

In the embodiment described above, to compare the color processing using color separation according to the colors of Y, M and C, with the black-and-white processing, a description is provided for the printing process to the individual information printing region 105 (excluding letter information that is printed to the letter printing region 103) and the printing process to the letter printing region 103. In the image information composing process, all image information including letter information printed to the letter printing region 103 and image information included in the individual information printing region 105 are made into a composite, thereby making it possible to print to the individual information printing region 105 and the letter printing region 103 using a single printing process.

Furthermore, it is also possible for a printing process to the individual information printing region 105 without presuming the use of color and only using a black-and-white process. Also, an example is provided for receiving image information of the rewrite printing region 101 in black-and-white bitmaps format. It is also perfectly acceptable to receive text, point size, and font from an external computer to print to the rewrite printing region 101.

The example is provided in the second embodiment of disposing an information recording unit 20 on the second transport path p2 and a second information recording unit 20B on a third transport path p3. It is also perfectly acceptable to reverse that arrangement. In other words, it is acceptable to establish the second information recording unit 20B on the second transport path p2 and the information recording unit 20 on the third transport path p3.

The disclosures of Japanese Patent applications No. 2003-431793, filed on Dec. 26, 2003, and No. 2003-431888, filed on Dec. 26, 2003, are incorporated in the application.

While the invention has been explained with reference to the specific embodiments of the invention, the explanation is illustrative and the invention is limited only by the appended claims.

What is claimed is:

1. A thermal transfer printing apparatus, comprising:

a printing device for printing an image onto a card medium having at least a first printing region in which coloring and deleting of color can be repeated through application of heat and a second printing region in which the coloring and the deleting of color can not be repeated, said printing device including a single thermal head for printing the images in both first printing region and second printing region, an image deleting device for deleting the image printed in the first printing region through application of heat, and a transport device for transporting a thermal transfer film having a transfer layer on a base film, and a control device for controlling the transport device according to a process of printing the first printing region and the second printing region with the thermal head.

2. A thermal transfer printing apparatus according to claim 1, wherein said control device controls the transport device so that a portion of the base film without the transfer layer formed intermittently in the thermal transfer film, is situated between the thermal head and the card medium when the thermal head prints the image in the first printing region.

3. A thermal transfer printing apparatus according to claim 2, further comprising a detection device for detecting a detection member disposed adjacent to said portion of the base file, said detection device detecting the detection member so that the control device controls the transport device to position said portion when the thermal head prints the image in the first printing region.

4. A thermal transfer printing apparatus according to claim 1, wherein said control device controls the transport device of the thermal transfer film including the base film, a first transfer layer having at least one of a thermal sublimate ink and a thermal fusion ink and formed on the base film, and a second transfer layer having a substantial transparency and formed on the base film alternately with the first transfer layer so that a portion of the base film having the second transfer layer transferred to the second printing region with the thermal head is situated between the thermal head and the card medium before the thermal head prints the image in the first printing region.

5. A thermal transfer printing apparatus according to claim 4, further comprising a detection device having a light emitting element and a light receiving element arranged with the thermal transfer film in between, said control device controlling the transport device to position a leading edge of said portion for the thermal head to print in the first printing region when the at least one of the thermal sublimate ink and the thermal fusion ink arranged adjacent to the portion blocks light from the light emitting element and the light receiving element does not receive the light.

6. A thermal transfer printing apparatus according to claim 5, further comprising a judging device for judging whether a transfer processing region of the second transfer layer to be transferred to the second printing region is larger than a print processing region to be transferred to the first printing region, said thermal head transferring the second transfer layer to the second printing region and printing in the first printing region through said portion of the base film sequentially when the transfer processing region is larger than the print processing region.

7. A thermal transfer printing apparatus according to claim 4, further comprising a judging device for judging whether a transfer processing region of the second transfer layer to be transferred to the second printing region is larger than a print processing region to be transferred to the first printing region, said thermal head transferring the second transfer layer to the second printing region and printing in the first printing region through said portion of the base film sequentially when the transfer processing region is larger than the print processing region.

8. A thermal transfer printing apparatus according to claim 1, further comprising a thermal transfer sheet retracting device for retracting a thermal transfer film from a printing position of the thermal head when the thermal head prints the image in the first printing region.

9. A thermal transfer printing apparatus according to claim 1, further comprising a card turning device arranged adjacent to the thermal head for turning the card medium.

10. A thermal transfer printing apparatus according to claim 1, wherein said thermal head includes a heat generating element on a leading edge thereof, said image deleting device being formed by the thermal head.

11. A thermal transfer printing apparatus according to claim 1, wherein said image deleting device is a heat roller provided with a heat source unit.

12. A thermal transfer film for a thermal transfer printing apparatus having a thermal head to form an image on a card medium through application of heat, comprising:

a plurality of transfer sections having transfer layers transferable to the card medium, non-transfer sections without the transfer layer, said plurality of transfer sections and the non-transfer sections being arranged alternately, a base film with the plurality of transfer sections and the non-transfer sections formed thereon, said base film being disposed at a bottom of the nontransfer sections, and a detection member disposed between the plurality of transfer sections and the non-transfer sections for position detection.

13. A thermal transfer film according to claim 12, wherein said plurality of transfer sections includes at least one of a thermal sublimate ink layer and a thermal fusion ink layer, and a substantially transparent protective layer for protecting a surface of the card medium formed with the ink layer, said transparent protective layer and at least one of the thermal sublimate ink layer and the thermal fusion ink layer being arranged sequentially.

14. A thermal transfer film according to claim 13, wherein said at least one of the thermal sublimate ink layer and the thermal fusion ink layer includes a plurality of thermal sublimate ink layers and a single thermal fusion paint layer arranged sequentially.

15. A combination comprising a card medium, a thermal transfer printing apparatus and a thermal transfer film, wherein said card medium includes a predetermined printing region having a leuco dye and a developing agent; said thermal transfer film includes a plurality of sections having transfer layers transferable to the card medium and a single section without the transfer layer, said plurality of the sections and the single section being arranged alternately; and said printing apparatus comprises a printing device for printing an image in the predetermined printing region on the card medium while contacting the single section of the thermal transfer film.

* * * * *